US009331388B2

(12) United States Patent
Lindenmeier et al.

(10) Patent No.: US 9,331,388 B2
(45) Date of Patent: May 3, 2016

(54) EMITTER FOR VERTICALLY POLARIZED WIRELESS SIGNALS

(71) Applicant: DELPHI DEUTSCHLAND GMBH, Wuppertal (DE)

(72) Inventors: Stefan Lindenmeier, Gauting-Buchendorf (DE); Heinz Lindenmeier, Planegg (DE); Jochen Hopf, Haar (DE); Leopold Reiter, Gilching (DE)

(73) Assignee: Delphi Deutschland GmbH (DE)

( * ) Notice: Subject to any disclaimer, the term of this patent is extended or adjusted under 35 U.S.C. 154(b) by 202 days.

(21) Appl. No.: 13/953,010

(22) Filed: Jul. 29, 2013

(65) Prior Publication Data

US 2014/0028512 A1 Jan. 30, 2014

(30) Foreign Application Priority Data

Jul. 29, 2012 (DE) ..... 10 2012 014 913

(51) Int. Cl.
*H01Q 11/12* (2006.01)
*H01Q 7/00* (2006.01)
*H01Q 1/32* (2006.01)

(52) U.S. Cl.
CPC ..... *H01Q 7/00* (2013.01); *H01Q 1/3275* (2013.01)

(58) Field of Classification Search
CPC ..... H01Q 7/00; H01Q 1/3275
USPC ..... 343/741, 866, 748, 870
See application file for complete search history.

(56) References Cited

U.S. PATENT DOCUMENTS

| | | | | |
|---|---|---|---|---|
| 6,693,598 | B1 * | 2/2004 | Bishop et al. | 343/741 |
| 8,319,688 | B2 * | 11/2012 | Parsche | 343/700 MS |
| 8,599,083 | B2 * | 12/2013 | Lindenmeier et al. | 343/744 |
| 8,643,556 | B2 * | 2/2014 | Lindenmeier et al. | 343/732 |
| 2003/0063040 | A1 | 4/2003 | Miyata et al. | |
| 2009/0073072 | A1 | 3/2009 | Lindenmeier et al. | |
| 2012/0050120 | A1 | 3/2012 | Lindenmeier et al. | |
| 2013/0257678 | A1 | 10/2013 | Lindenmeier et al. | |

FOREIGN PATENT DOCUMENTS

| | | | |
|---|---|---|---|
| DE | 10 2008 003532 | A1 | 3/2009 |
| EP | 2 296 227 | A2 | 3/2011 |
| EP | 2 424 036 | A2 | 2/2012 |
| GB | 1 105 354 | A | 3/1968 |
| NL | 6 602 498 | A | 8/1967 |

OTHER PUBLICATIONS

European Search Report dated Nov. 27, 2013.

* cited by examiner

*Primary Examiner* — Hoanganh Le

(57) ABSTRACT

An electric emitter for vertically polarised wireless signals for a communication service with a narrow frequency bandwidth around a frequency fo with free-space wavelength λo in the gigahertz range, comprising at least one substantially horizontally oriented conductor loop arranged above a conductive base area, with an emitter infeed point for electromagnetic excitation of the loop relative to the base area. The loop is formed by a circularly closed ring conductor running in a substantially horizontal plane with a height h of less than λo/6 over the base area. Distributed over the periphery of the ring conductor are at least three vertical emitters electromagnetically coupled to the ring conductor coupling points and running to the base area, wherein at least two of the emitters are electromagnetically coupled to the base area at earth terminal points, and a vertical emitter is excited via the emitter infeed point at the lower end thereof.

15 Claims, 17 Drawing Sheets

Azimuthaldiagramm bei Elevation Theta=90° Gmin: 5,31dBi

Gmax: 5,57dBi

EMITTER FOR VERTICALLY POLARIZED WIRELESS SIGNALS

TECHNICAL FIELD OF THE INVENTION

The invention relates to an electric emitter for vertically polarised wireless signals for a wireless communication service with a narrow frequency bandwidth around a frequency fo with free-space wavelength λo in the gigahertz range for preferential use on vehicles.

BACKGROUND OF THE INVENTION

Due to the large number of wireless communication services of which the availability has become indispensable in vehicles, in the design of aerials a small overall installed size in conjunction with as low a height as possible is particularly important. Often with good aerial performance it is not possible and not appropriate to cover a number of wireless communication services which operate in frequency ranges which are in each case relatively narrow, but relatively far apart from each other in frequency, with an aerial which works in broadband mode. Often the wireless signals of the different wireless communication services are also emitted with different polarisation, so that it is not appropriate to meet the different requirements with one aerial. In fact it is important for vehicle aerials to provide, for the individual wireless communication services, aerials with filigree structures which, particularly with always a height as low as possible and frequently with a small base area, can be combined with aerials for other wireless communication services in order to provide combination aerials with small space requirements. Such combination aerials are, if occasion arises, covered with a plastic sheath to form a a radome or even countersunk in a moulding in the vehicle body as a cavity. In addition, high demands are made of the design of vehicle aerials with respect to their mechanical stability and vibration resistance. A look at just a few of the aerials as examples of the wireless communication services in the decimetre wave range often required for the vehicle, such as aerials for GSM mobile telephone services and the digital radio service of narrow frequency bandwidth in the L-band around 1.5 GHz with wireless signals that are in each case emitted with vertical polarisation as well as the SDARS narrow-band digital satellite radio service around 2.3 GHz, the signals of which are emitted in circular polarisation by the satellite, shows that the provision of a single broadband aerial for covering all wireless communication services would lead to almost insuperable difficulties. In addition, for the reception of all these wireless communication services on the basis of aerials manufactured on a large scale, economic efficiency during manufacture is of crucial importance.

BRIEF DESCRIPTION OF THE INVENTION

For the GSM mobile telephone service, vertical emitters such as are described in EP 1 445828, for example, have long been used. To make such emitters smaller, a top-load such as is described for example in Meinke-Gundlach, Manual of High-Frequency Technology, Springer-Verlag 1986, no. 16, table 1, as well as in connection with illustration 6 for the primary emitter there, can be used. The minimum required height h for such an electrically short monopole emitter, when it is supplemented by an inductance 15 as in FIG. 4*a* with an inductance value Lm, is calculated by the frequency bandwidth requirements B for the wireless communication service concerned at its centre frequency fo with the free-space wavelength λo. This correlation between the relative emitter bandwidth Brel=B/fo, the radiation resistance Rsm and its capacitance Csm is shown in Archiv für Elektronik and Übertragung in Volume 30 (1976), Book 9, in equation 11, and, taking into consideration the known relation for the radiation resistance, Rsm=160*π²*(hem/λo)² ohms, of the short monopole emitter with its effective height hem, is

*a.*

$$\frac{B}{fo} = (hem^2 * Cs) * fo^3 * \frac{Zo}{co^2} * \pi^2 * \frac{8}{3} = (hem^2 * Cs) * k = BFm * k \tag{1}$$

where Zo=120π ohms=characteristic wave impedance of the free space and the speed of light co.

The crucial mechanical dimensions of the aerial are, for the considerations here, contained in brackets exclusively in the expression for the bandwidth factor BFm, where, with a sufficiently high top load Cs, the effective height, hem, of the monopole emitter is equal to its geometric height h. To fulfil the relative bandwidth of an electrically short emitter for a given wireless communication service with centre frequency fo, the term outside the brackets can therefore be summed up as "bandwidth factor"=BFm for the monopole at a constant k which is independent of its dimensions. This emitter bandwidth constitutes the reference bandwidth below. In the impedance graph in FIG. 4*a* the impedance curve of the emitter is shown as a curve in the frequency range around the resonant frequency fo, wherein the impedance at the point of resonance shows the radiation resistance Rsm which, referred to a standardised resistance (target impedance) ZL=50 ohms, can be represented as follows from the above relations for this primary emitter:

$$\frac{Rsm}{ZL} = 3,\ 2 * \pi^2 * \left(\frac{hem}{\lambda o}\right)^2 \approx 32 * \left(\frac{h}{\lambda o}\right)^2 \tag{2}$$

With respect to the use of such a resonance emitter 29 at the bottom of FIG. 4*a*, this radiation resistance Rsm referred to ZL is particularly important for use in vehicles. Due to its extreme placement of the matching point ZL=50 ohms for ordinary wireless communication systems in the vehicle, the conversion of this resistance to the matching point ZL in the matching network 35 is elaborate with electrically small aerials 36 and reduces the bandwidth of the aerial at the aerial terminal point 34, so that the above emitter bandwidth B according to equation (1) is no longer available there. Added to this is the fact that matching networks 35, particularly when they are formed from complex circuit structures, make it expensive to manufacture vehicle aerials. The impedance of a known capacitive emitter with top load with inductance Lm 15 for generating a resonance as an example at a frequency fo of approximately 1.5 GHz in the frequency band of a wireless communication service concerned, as in FIG. 4*a*, is therefore very unfavourable, particularly with the mechanical dimensions given there and the electrically low height h/λo of approximately 1/20. Added to this is the mechanical instability which comes with the structure of the emitter mechanically loaded with the top load at the upper end. With respect to its electrical properties, this emitter shall be used as the reference emitter 29 below.

It is therefore an object of the invention to provide an emitter according to the introductory part of claim 1 which, even with an electrically very low height h/λo and with mechanical stability in the frequencies around its resonant frequency fo, has an impedance in the vicinity of the resistance prescribed and standardised for wireless communication systems in vehicles of ZL=50 ohms, so that the technical elaborateness for supplementing the emitter with a matching network for matching to ZL=50 ohms to an aerial can be made economical over a relatively large frequency bandwidth.

This object is achieved in an aerial according to the introductory part of the main claim by the characterising features of the main claim.

According to the invention, the (electrically small) emitter 1 for vertically polarised wireless signals for a wireless communication service with narrow frequency bandwidth around a frequency fo with the free-space wavelength λo in the gigahertz range comprises a substantially horizontally oriented conductor loop arranged above a conductive base area 6 with an emitter infeed point 5 for electromagnetically exciting the conductor loop relative to the conductive base area 6. The conductor loop is formed by a polygonally or elliptically/circularly closed ring conductor 2 running in a substantially horizontal plane with a height h of less than λo/6 over the conductive base area 6. Distributed over the periphery of the ring conductor 2 are at least three vertical emitters 4, 4*b*, 4*c*, 4*d* electromagnetically coupled to the ring conductor 2 at conductor loop coupling points 7 and running to the conductive base area 6, wherein at least two of the vertical emitters 4*b*, 4*c* and, if occasion arises, 4*d* are electromagnetically coupled to the electrically conductive base area 6 at earth terminal points 3*b*, 3*c*, 3*d*, and a vertical emitter 4*a* is excited via the emitter infeed point 5 at the lower end thereof. The vertical emitters 4*b*, 4*c*, 4*d* coupled to the electrically conductive base area 6 between their conductor loop coupling points 7*a*, 7*b*, 7*c*, 7*d* and the earth terminal point 3*b*, 3*c*, 3*d* and the one which is excited via the emitter infeed point 5, between its conductor loop coupling point 7*a* and the emitter infeed point 5,in each case have inductively operating components 13*a*, 13*b*, 13*c*, 13*d*, so that a low-resistance resonance having the character of a series resonance is provided at the emitter infeed point 5 at the frequency fo.

An emitter according to the invention provides the added advantage that the emitter gain in the case of flat radiation, even with a very low electrical emitter height, can be made greater than with a primary emitter by flattening the vertical directional diagram with azimuthal round characteristic. Furthermore, the emitter can be manufactured as a filigree and yet mechanically stable structure which allows combination with a further vertically polarised aerial. A particular advantage here is the possibility of an extremely economical way of manufacturing the emitter in large numbers, which is particularly important for use in vehicles. Furthermore, the emitter according to the invention can be designed as a circularly polarised aerial by uncomplicated supplementary measures for an additional further frequency range, particularly for the reception of satellite wireless signals. An essential advantage of an emitter according to the invention is further provided by the possibility that the region on the base area which remains free at the centre of the ring circuit can be used largely for mounting further combined aerials for additional other wireless communication services.

These and other features and advantages of this invention will become apparent upon reading the following specification, which, along with the drawings, describes preferred and alternative embodiments of the invention in detail.

BRIEF DESCRIPTION OF THE DRAWINGS

The invention is described in more detail below with the aid of practical examples. The associated drawings show in detail:

FIGS. 6C and 6D shows that the resistance Rs/ZL at the resonant frequency fo is not influenced much by the difference in design of the emitters. Further, it turns out that the relative bandwidths Brel=3.6% of the two emitters in FIGS. 6A & 6B and 6C & 6D do not differ in practice within the scope of verifiability. Allowance is made for the extremely slightly different effect of the different ring conductors 2 by slight readjustment of the inductances 15*a*, 15*b*, 15*c*, 15*d;*

Although the drawings represent embodiments of the present invention, the drawings are not necessarily to scale and certain features may be exaggerated in order to illustrate and explain the present invention. The exemplification set forth herein illustrates an embodiment of the invention, in one form, and such exemplifications are not to be construed as limiting the scope of the invention in any manner.

DETAILED DESCRIPTION OF THE INVENTION

Figure 4A:
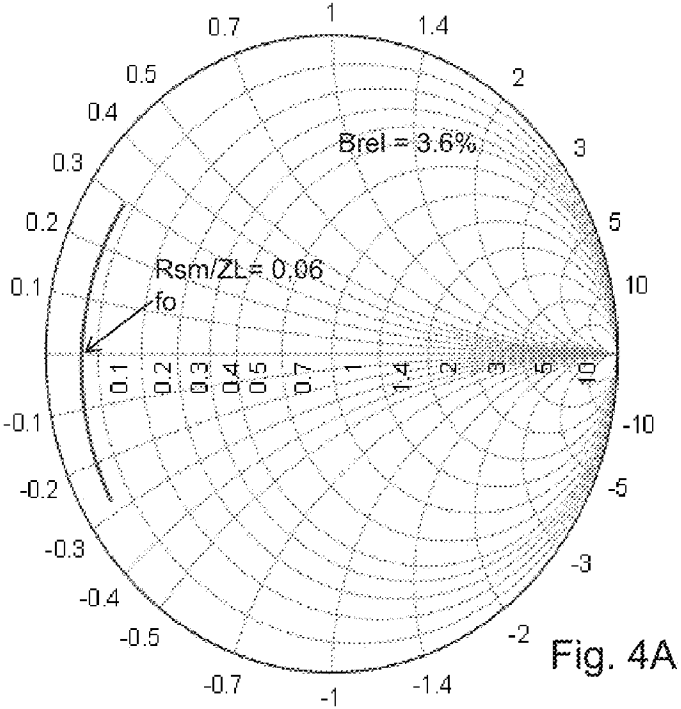
FIGS. 4A through 4E illustrate a comparison of the impedance curves of an emitter with square ring conductor 2 according to the invention as in FIGS. 4D and 4E, and a rod monopole with square top load and base inductance Lm 15 as a reference emitter 29 as in FIGS. 4A through 4C in the complex impedance plane referred to ZL, in each case in the vicinity of the resonant frequency fo=1.4 GHz with the same height h=1 cm and the same edge length 23 of 2 cm of the square top load of the reference emitter 29 and the square ring conductor 2 with a conductor width 8 of 2 mm of the emitter 1 according to the invention. The external dimensions of the two emitters 1 and 29, which are equal to each other, at first cause equal relative emitter bandwidths of Brel=3.6%. The difficulty of matching the emitter impedance to ZL, which is associated with the extremely low resonance resistance Rsm/ZL=0.06 as in FIGS. 4A through 4C, does however require high technical expenditure and a reduction in the effective relative bandwidth of the emitter supplemented by a matching network 35. The merit of the present invention is that these drawbacks can be eliminated in practice in an emitter according to the invention where Rs/ZL=0.85 as in FIGS. 4D and 4E.

The description of the manner of operation of an emitter according to the invention can be given by illustration with the aid of a comparison with the electrically small monopole rod emitter in FIG. 4*a* already mentioned above and referred to as the reference emitter 29, with top load 11 and an inductance Lm, 15 at the base according to the state of the art. Its base impedance at the emitter infeed point 5 is capacitive at low frequencies and, if a suitable inductance Lm 15 is chosen at the frequency fo of a wireless communication service considered here, assuming a low-resistance resonance having the character of a series resonance circuit with the very low resonance resistance Rsm/ZL=0.06 with respect to ZL=50 ohms This known impedance curve is shown as an example in the frequency range around the resonance fo=1.5 GHz for the emitter shown with the dimensions given and the resonance resistance Rsm/ZL=0.06 which is extremely unfavourable for impedance conversion to the resistance ZL.

Figure 1:
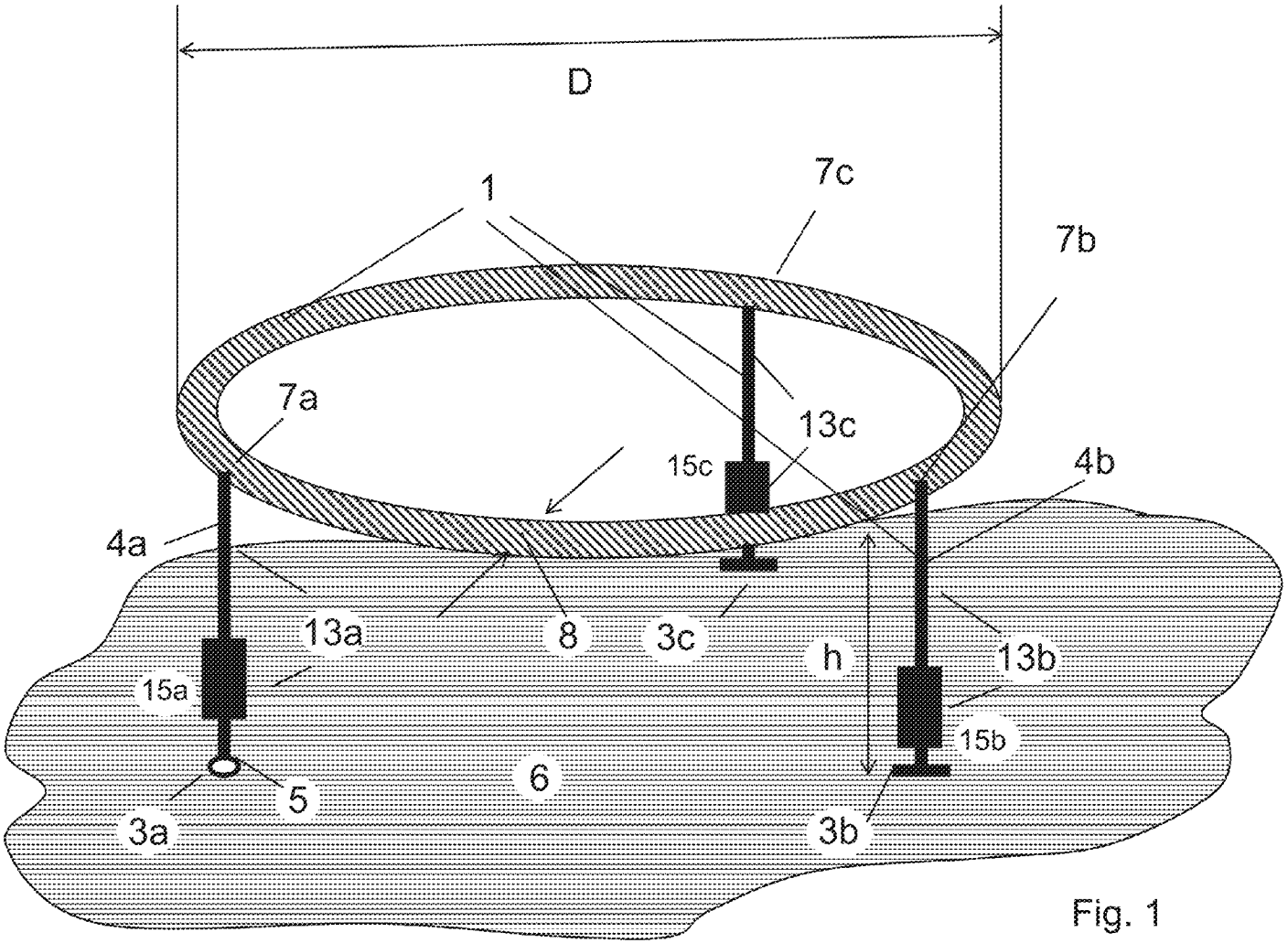
FIG. 1, illustrates an emitter 1 according to the invention with a circular, for example wire-like ring conductor 2 extending at height h above a conductive base area 6, with N=3 vertical emitters 4*a*, 4*b*, 4*c* connected to the ring conductor at ring circuit coupling points 7*a*, 7*b*, 7*c*, wherein two vertical emitters 4*b*, 4*c* are connected at their lower end via earth terminal points 3*b*, 3*c* to the conductive base area 6, and at the lower end of one of the vertical emitters 4*a* is formed the emitter infeed point 5,via which, the emitter 1 is excited. All the vertical emitters 4*a*, 4*b*, 4*c* have inductively operating components 13*a*, 13*b*, 13*c* for causing low-resistance resonance approximately at the middle frequency fo of the wireless communication service with vertical polarisation.
Figure 4B:
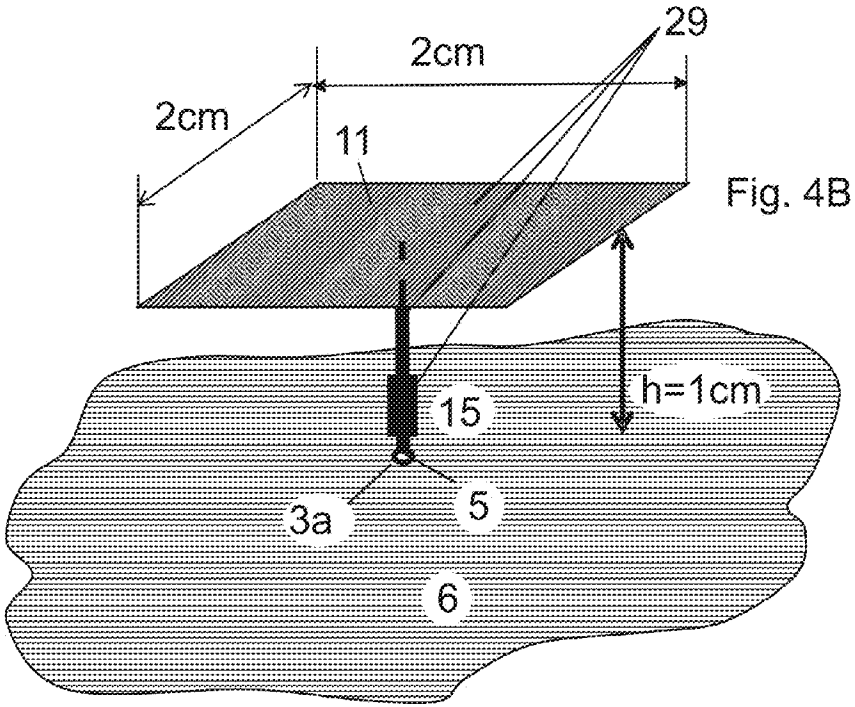
Figure 4C:
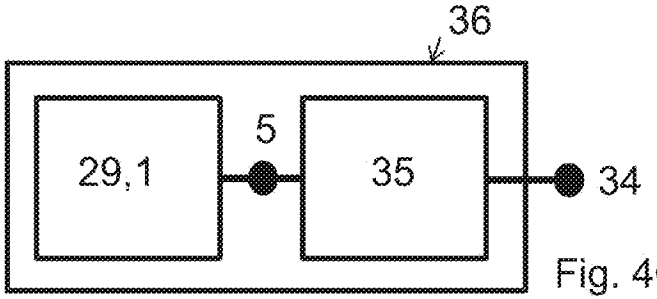
Figure 4D:
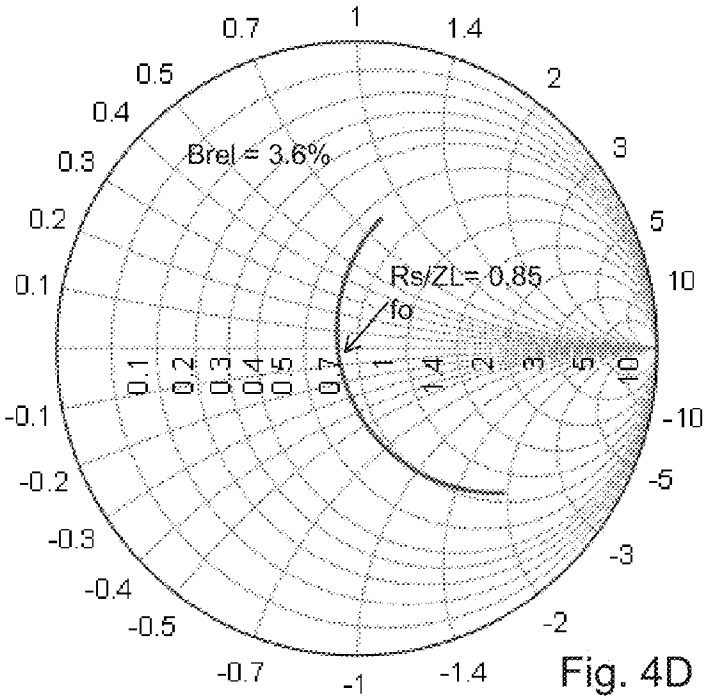
Figure 4E:
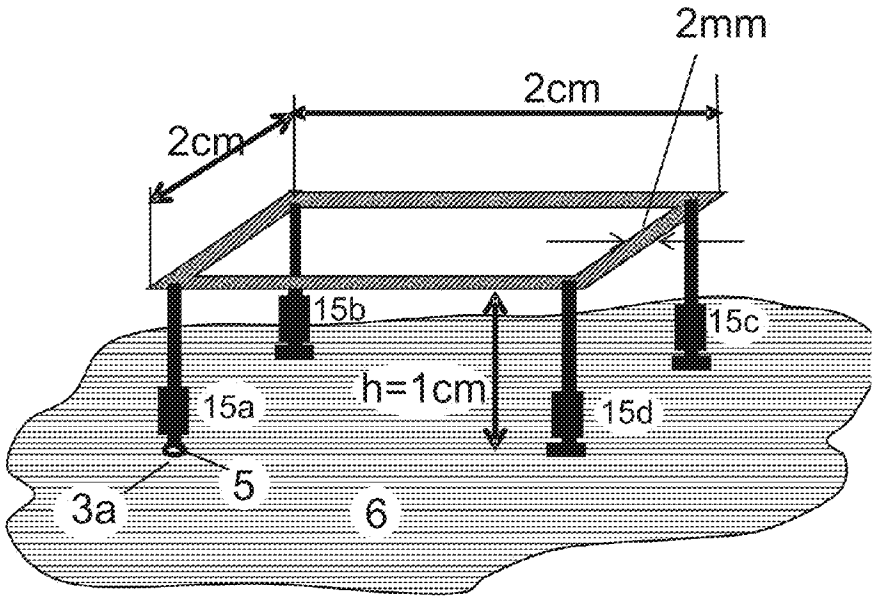
Figure 6A:
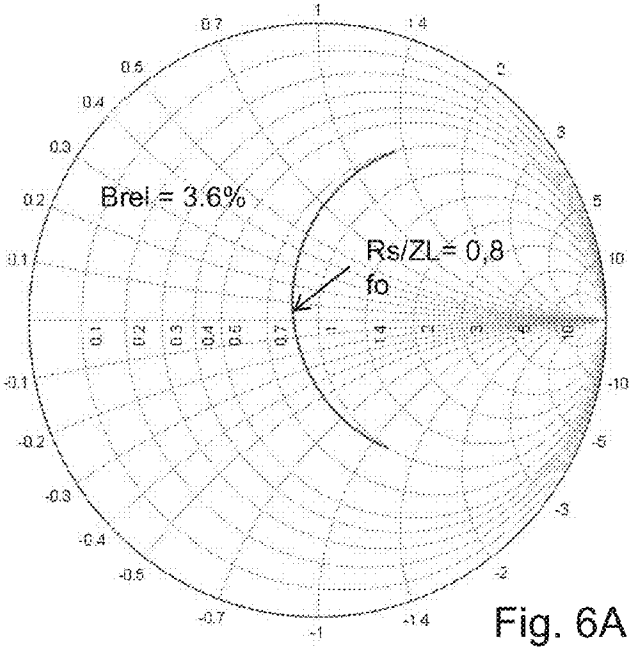
FIGS. 6A through 6D, illustrate impedance curves of emitters according to the invention with external dimensions as in FIGS. 4D and 4E, but with a conductor width 8 of 5 mm in FIGS. 6A and 6B and with the peculiarity in FIGS. 6C and 6D that the width of the ring conductor 2 is selected such that within the outer boundary of the ring conductor 2 is formed a closed surface. A comparison of the impedance curves in FIGS. 6A & 6B
Figure 6B:
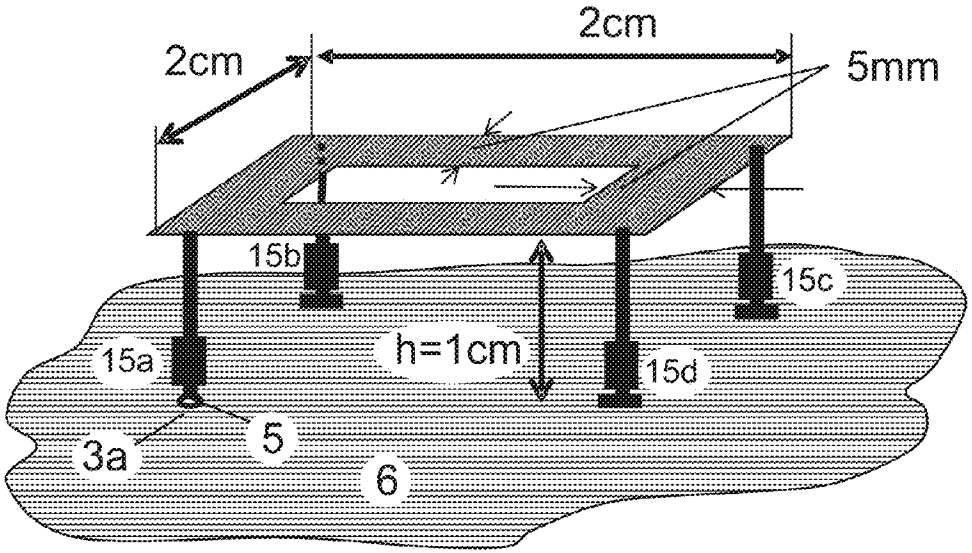
Figure 6C:
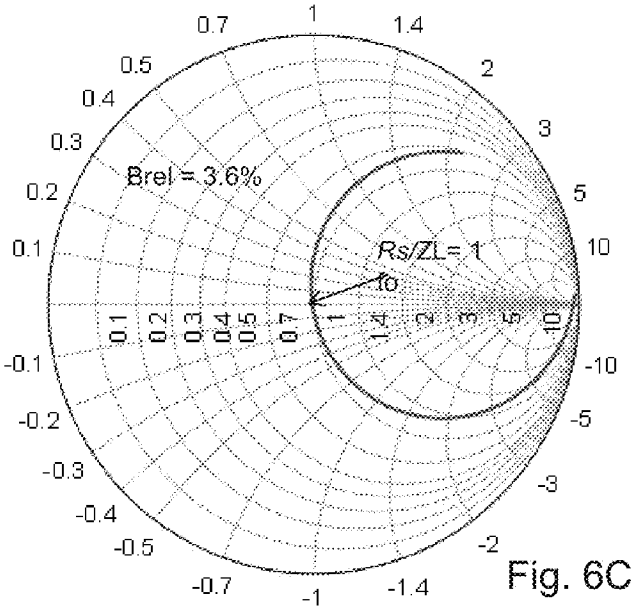
Figure 6D:
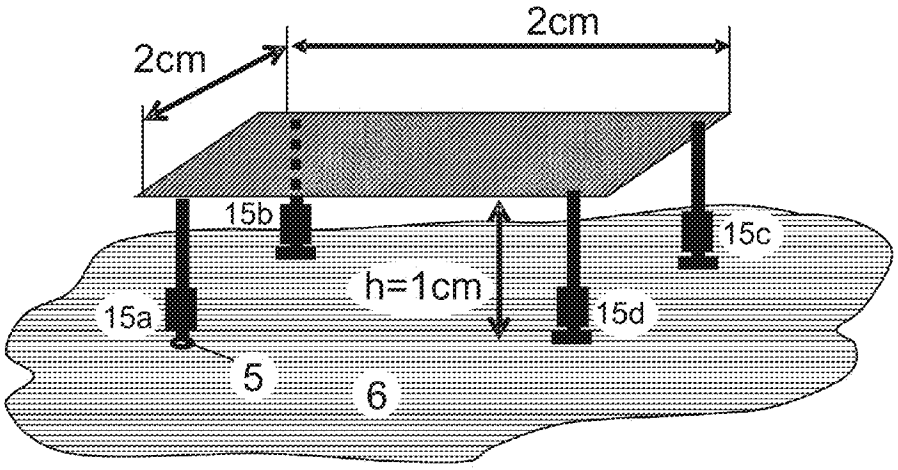
Figure 12:
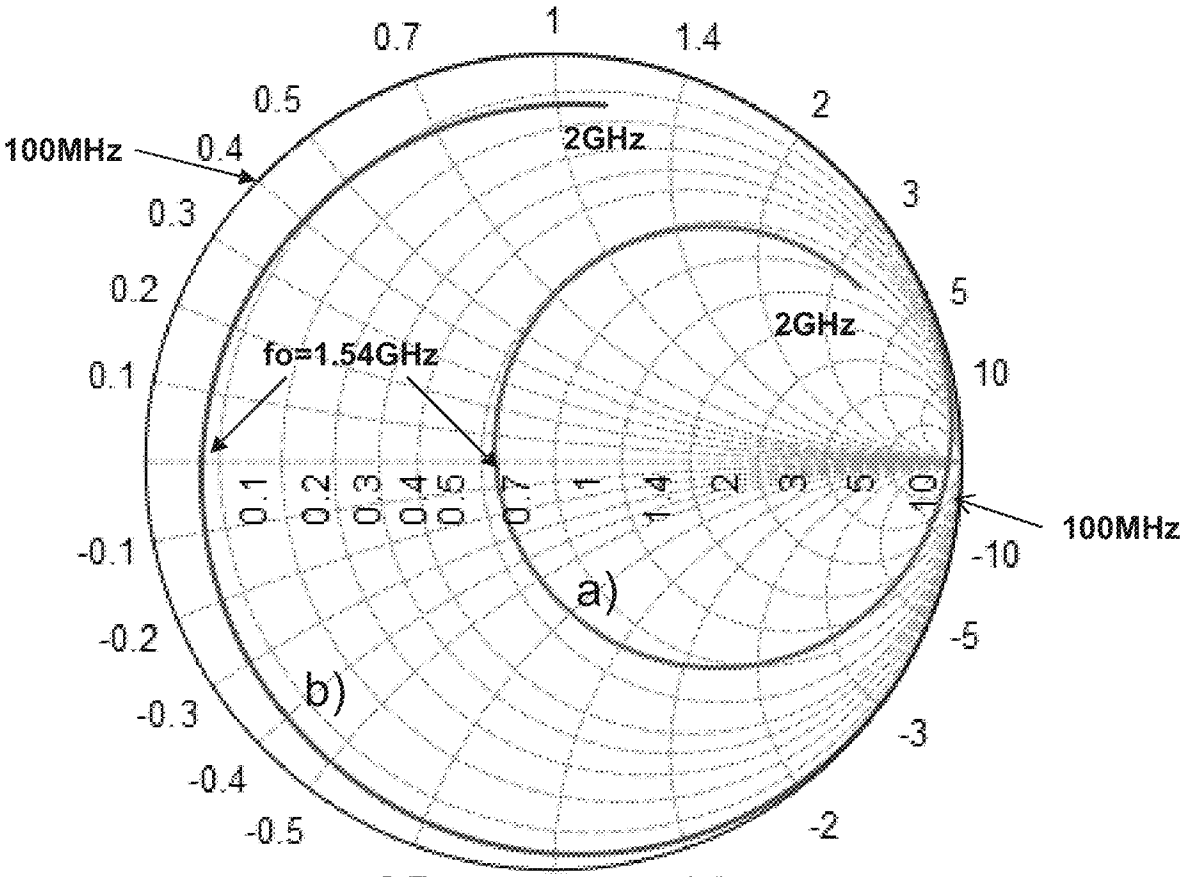
FIG. 12, illustrates a comparative drawing of the impedance curves referred to ZL, of an emitter with circular ring circuit and four vertical emitters according to the invention in curve a) and a monopole with top load as a reference emitter 29 in curve b), in each case in the frequency range between 100 MHz and 2 GHz and at the same resonant frequencies fo=1.54 GHz. The different character of the two emitters is due to their behaviour at low frequencies, wherein the impedance in curve a) is inductive there and its real part increases with e and the impedance in curve b) is capacitive there and its real part increases more slowly, i.e. with $f^2$.

By contrast with the reference emitter 29 in FIGS. 4A through 4C, the emitter according to the invention in FIG. 1 and FIGS. 4*d* & 4E consists of a ring conductor 2 at the circumference of which are arranged at least three vertical emitters 4*a*, 4*b*, 4*c* and 4*d*, wherein the ring circuit 2 is excited via one of the vertical emitters 4*a* and the other vertical emitters 4*b*, 4*c* and 4*d* are in each case electroconductively connected via an inductance 15 to the conductive base area 6. In a particularly preferred embodiment of an aerial according to the invention, the vertical emitters 4*a-c* or *d* are approximately equally distributed azimuthally, and the inductance 15 of all emitters is selected approximately the same. Depending on the dimensions of the ring conductor 2 and its height h above the base area 6, with a suitable choice of inductances 15 according to the invention at the emitter infeed point 5 in the frequencies around the desired resonant frequency fo the impedance curve of a low-resistance series resonance is formed, as shown in FIGS. 4E, 6B, 6D and in FIG. 12, curve a). When an emitter according to the invention is excited at the emitter infeed point 5 at frequencies well below the resonant frequency fo, the impedance which is measurable there has the same character as that of an electrically small frame aerial of which the radiation resistance increases with $f^4$ and of which the reactance increases proportionally to the frequency f. For example in FIG. 1, due to the current in the emitter 4*a* supplied being oppositely directed to the two currents in the other vertical emitters 4*b* and 4*c*, it is easy to understand that the vertically polarised radiation contributions in the vertical emitters largely cancel each other out. Only at the frequencies around the resonant frequency fo are the currents in all vertical emitters in the same direction, so that the vertically polarised radiation contributions are added together in a fully supporting capacity. According to the invention this entails the crucial phenomenon that the real part of the impedance at the emitter infeed point 5 is greater approximately by the square of the number N of vertical emitters than with a reference emitter 29 having the same geometric height h according to equation (2), so that with an electrically low height h/λo and with a suitable choice of number N of vertical emitters 4, the emitter impedance can be made substantially closer to the target impedance ZL for impedance matching. According to the invention, in approximation to the resonance resistance of the emitter at frequency fo the following holds good:

$$\frac{Rs}{ZL} = \frac{Rsm}{ZL} * N^2 \approx 32 * \left(\frac{h}{\lambda o}\right)^2 * N^2 \tag{3}$$

Here, a particular advantage of an emitter according to the invention turns out to be that the bandwidth of its impedance curve is not less than that of a reference emitter 29 with the same external dimensions of the top load 11 or ring conductor 2 in FIGS. 4B or 4E and with the same height h/λo, so that approximately the same bandwidth factor BF=BFm according to equation (1) applies to both emitters. A comparison of the bandwidths of the impedance curves in FIG. 4*b* for the emitter according to the invention with the inductances 15 of approximately 25 nH each and in FIG. 4B for the reference emitter 29, yields within the scope of ascertainable accuracy the same values for the relative bandwidth of Bret=3.6%. This is determined by means of the frequency intervals of the impedances with +45° and −45° phase around the resonant frequency fo ~1.5 GHz.

Figure 2:
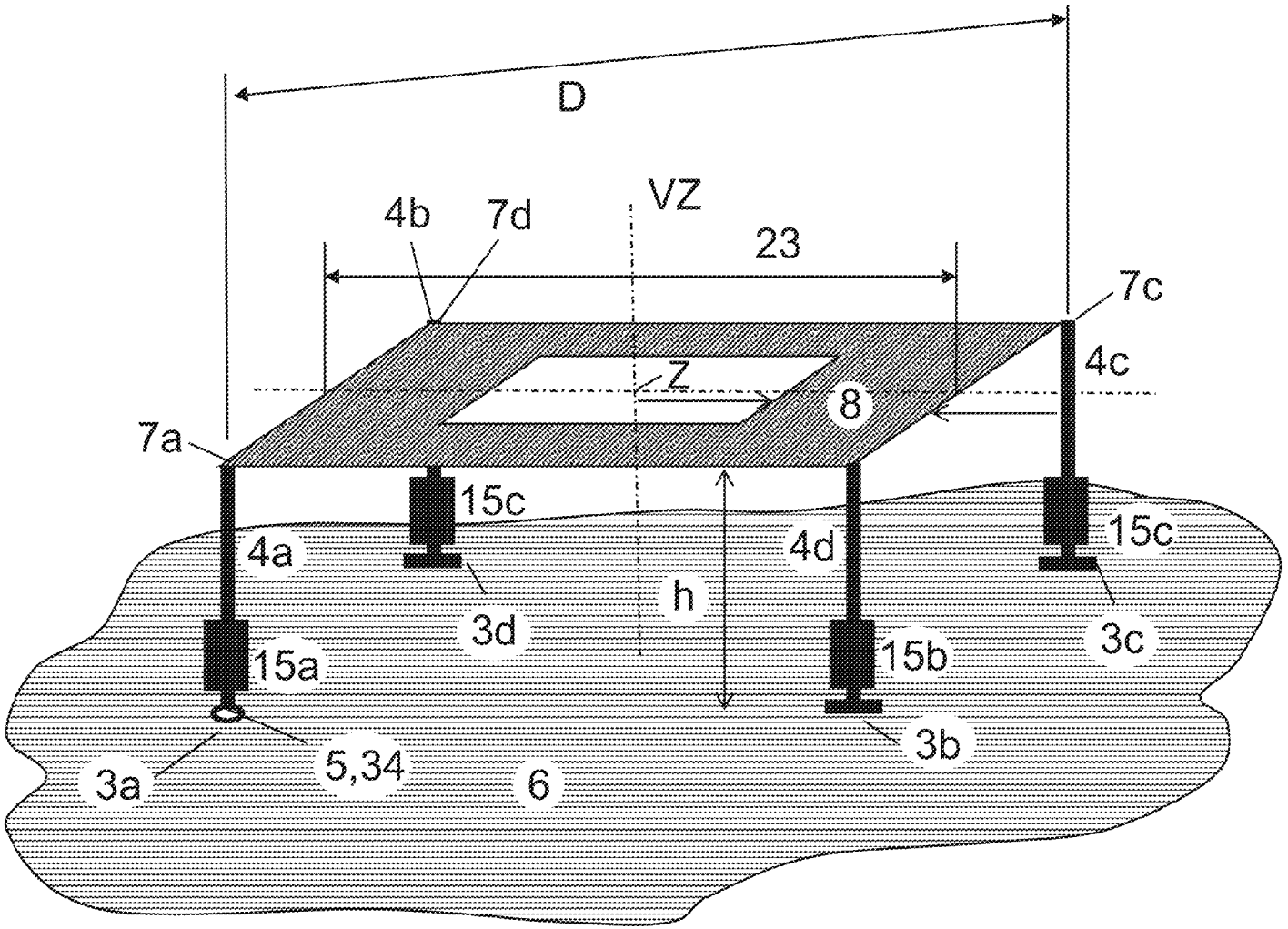
FIG. 2, illustrates the emitter according to the invention as in FIG. 1, but with a square or rectangular, for example two-dimensional ring conductor 2 and greater conductor width 8 and with N=4 ring circuit coupling points 7*a*, 7*b*, 7*c*, 7*d* for coupling the four vertical emitters 4*a*, 4*b*, 4*c*, 4*d* at its four corner points.

As already stated above, however, an aerial based on the reference emitter 29 with a matching network 35 for conversion of the emitter impedance to the target impedance ZL undergoes a bandwidth reduction, to which an emitter according to the invention is not subjected due to its favourable emitter impedance. Also, with an emitter according to the invention there is the added advantage that the bandwidth factor is practically independent of the conductor width 8 in FIG. 2. If the vertical emitters 4*a-d* according to the invention are mounted approximately at the outer boundary of the ring circuit 2, then the currents at the outer boundary of the ring circuit mainly contribute to forming the emitter properties, so that the bandwidth factor is practically independent of the conductor width 8, through to the special case of the ring conductor being formed by a closed surface, as in FIG. 6D. The impedances of the emitters according to the invention in FIGS. 4E, 6B and 6D show by comparison the resonance resistance Rs at frequency fo, which varies only insignificantly with an increase in ring conductor width 8. Hence the bandwidth of the emitter according to the invention is in the main dependent on the relative emitter height, that is, with $(h/\lambda o)^2$ and the capacitance of the ring conductor 2 at its outer boundary. It is, however, practically independent of the ring conductor width 8 or the diameter d of a mechanically inherently stable wire-like ring conductor 2, as can be seen from a comparison of the bandwidths given in FIGS. 6B and 6D. This leads to the essential advantage in the design of an aerial for vehicles, that the space at the centre Z of the emitter can be made available for combining with further emitters for other wireless communication services.

Figure 13:
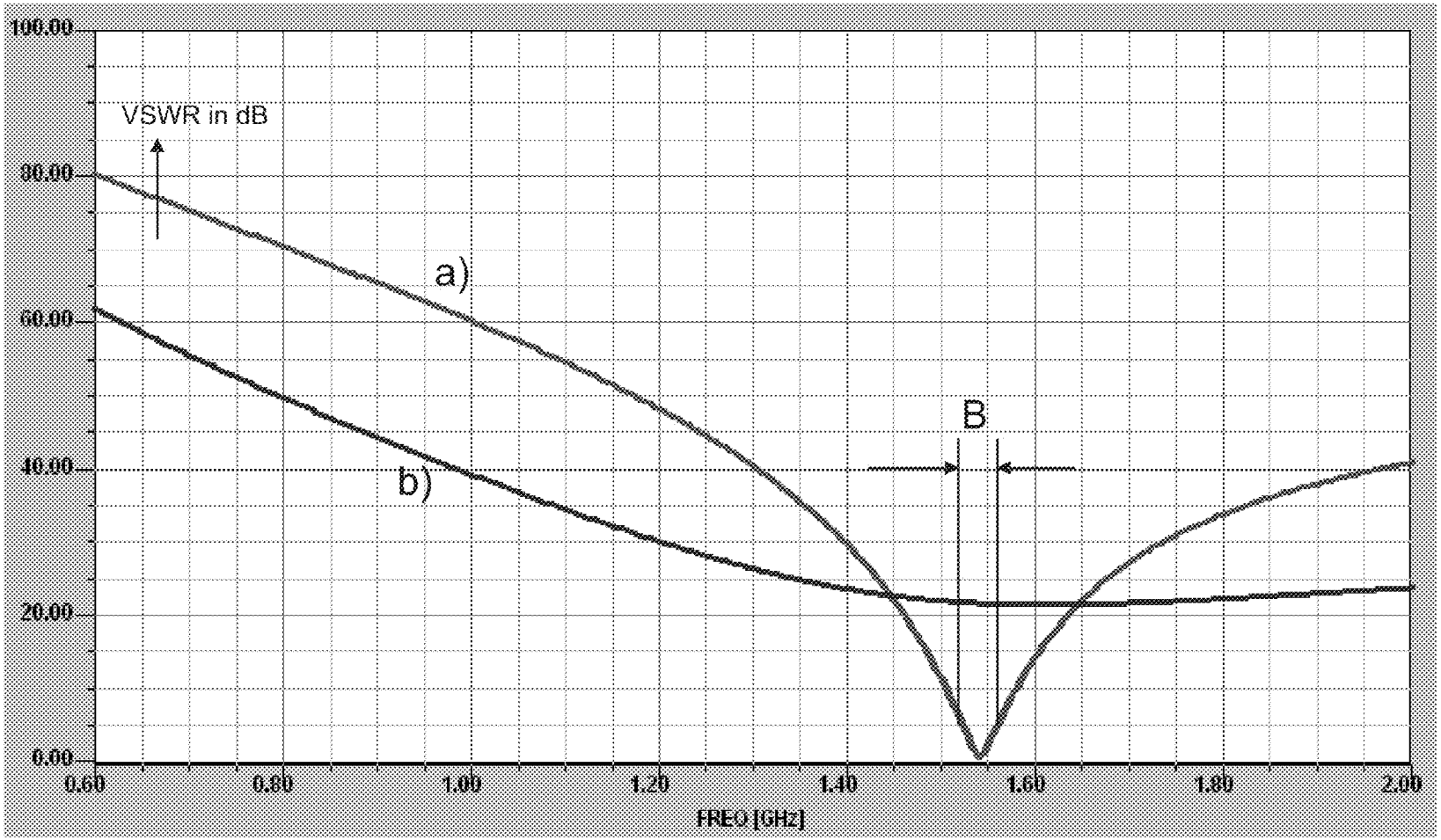
FIG. 13, illustrates proof of the advantageous frequency selectivity of the aerial according to the invention with the impedance curve a) in FIG. 12 with reference to the frequency curve of the VSWR, referred to the resistance ZL with curve a) in FIG. 12 with very low values in the frequency range with the effective bandwidth B around the resonant frequency fo and extremely favourable high values of the VSWR at frequencies greatly differing from fo. By contrast, the values of the VSWR in the impedance curve b) in FIG. 12 of the reference emitter 29 are unfavourably high in the useful range around fo and unfavourably low at frequencies far away.

Particularly for the design of combination aerials for several wireless communication services in a narrow space on vehicles, the frequency selectivity of an emitter 1 according to the invention is of particular advantage. This is clear from the comparison of the frequency curve of the VSWR values of an emitter 1 according to the invention with resonant frequency fo=1.53 GHz in FIG. 13, curve a), and a reference emitter 29 with the same external dimensions in curve b). In the region of the resonant frequency, the advantage according to the invention turns out to be effortless matching of the impedance of the emitter according to the invention to ZL=50 ohms compared with the reference emitter 29 with a VSWR value of more than 20 dB. On the other hand, the VSWR values of the reference emitter 29 far from the resonant frequency are on average about 20 dB greater, so that an emitter according to the invention is uncoupled more powerfully from adjacent aerials for other wireless communication services, such as mobile telephone services with strong transmitted radiation.

Figure 5:
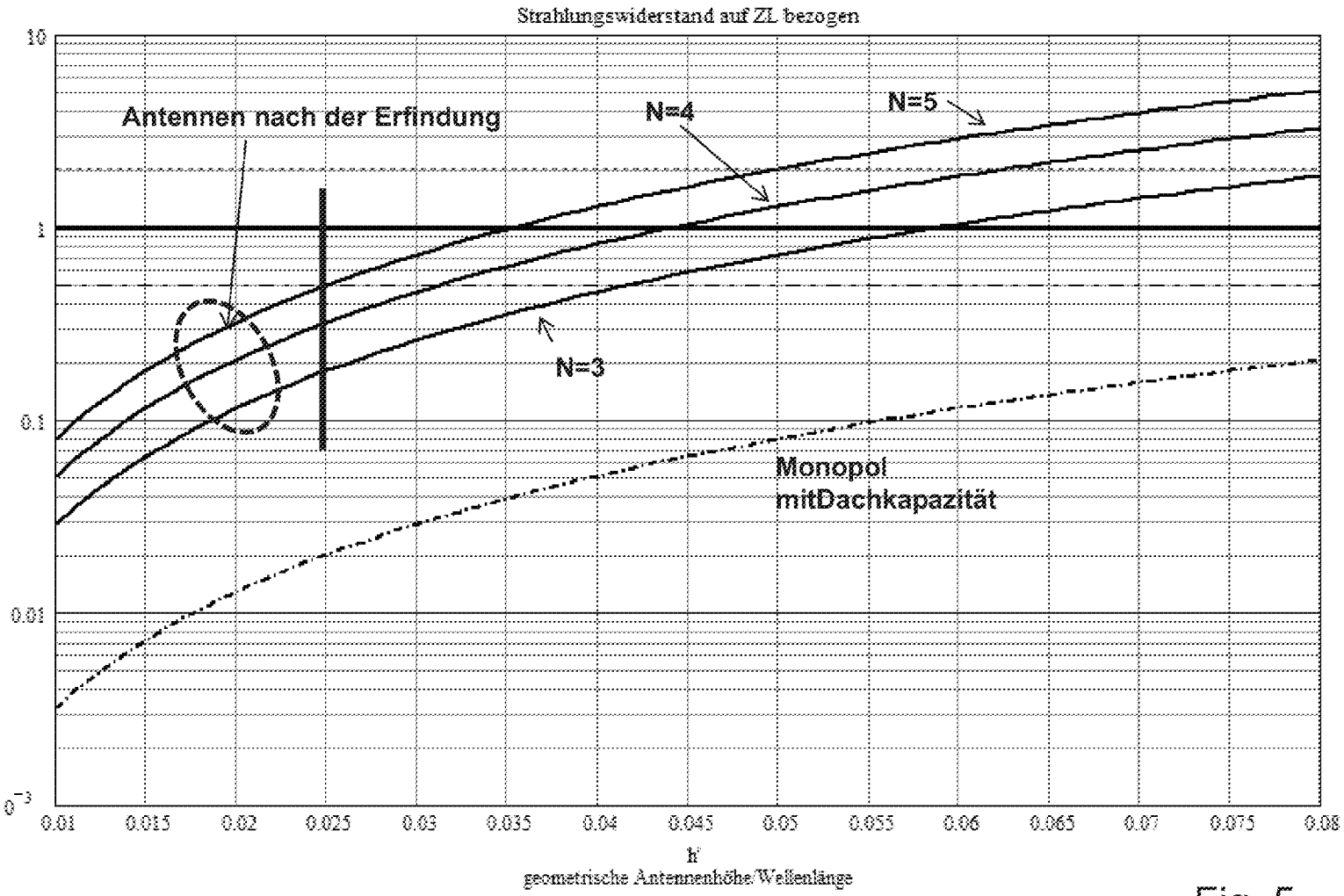
FIG. 5, illustrates a curve of the radiation resistance referred to ZL at the resonant frequency fo as a function of the relative geometric emitter height h/λo=h' of the reference emitter 29 (in dot and dash lines) and the emitter 1 according to the invention (N=4) in FIGS. 4D and 4E. The curves N=3, N=4 or N=5 refer to emitters 1 according to the invention each with a ring conductor 2 designed as a regular triangle, regular rectangle or pentagon with the same relative emitter bandwidth Brel. The range shown for h'>0.025 (see marker) characterises the usable range of values for h' when the requirement 0.5<Rs/ZL<2 (see boundary lines) is to be fulfilled as an example.

As already described above in connection with FIG. 5, the correlation between the resonance resistance at frequency fo is plotted over the relative geometric height h/λo=h' of the emitter in FIG. 4E where N=4. Compared with the curves where N=3 and N=5, it turns out that with a suitable choice of number N of vertical emitters on a ring conductor 2 designed as a polygon with N corners, the resonance resistance can be within a large range of values of h'=h/λo, which is of interest for practical application, in the vicinity of the target resistance ZL. The curve in the dot and dashed line for the impedance of the monopole with top load as the reference emitter 29 with the same external dimensions shows the low values which, by comparison, differ by more than an order of magnitude.

Figure 7:
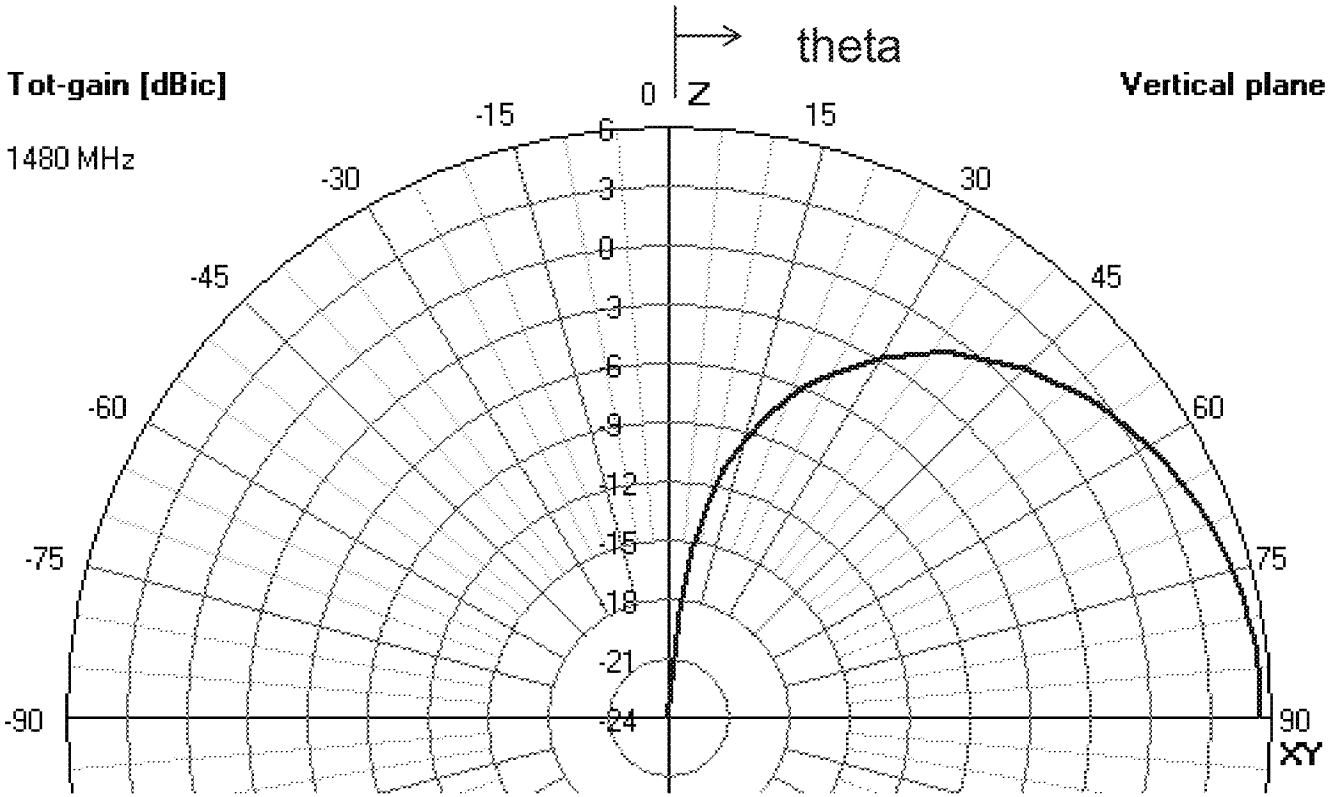
FIG. 7, illustrates the vertical directional diagram in dB calibration of an emitter according to the invention with a directivity of 5.57 dBi or 5.31 dBi higher than an electrically small primary emitter (4.77 dBi) due to the spaced-apart vertical emitters 4*a-d;*
Figure 8:
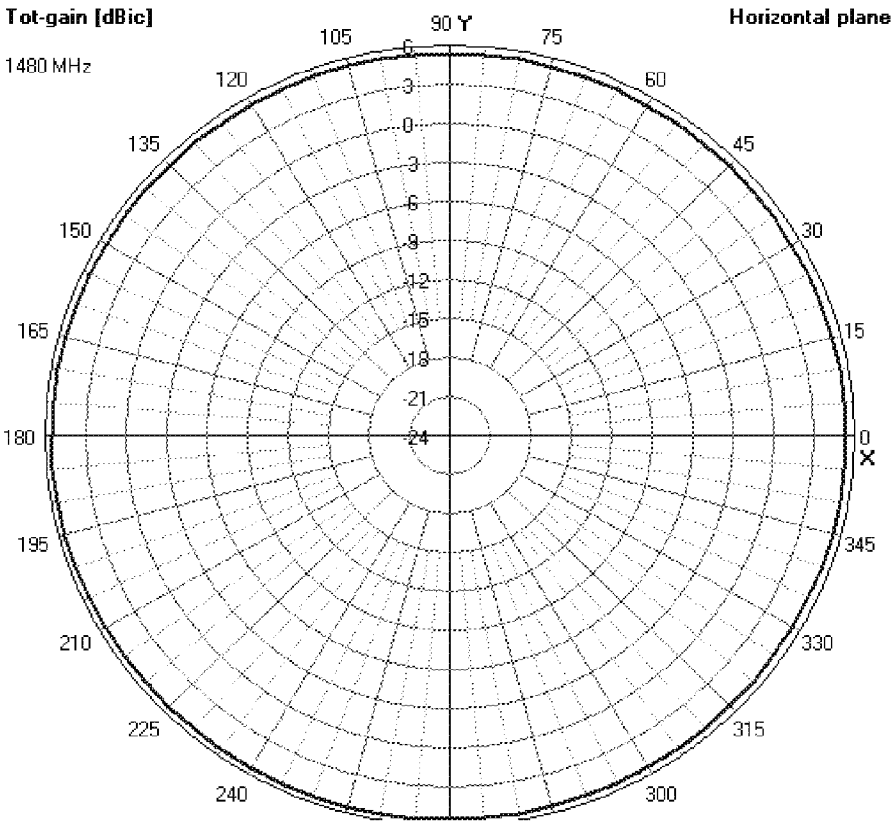
FIG. 8, illustrates the azimuthal directional diagram for flat radiation of the emitter discussed in FIG. 7, with only slight deviation from the round diagram with fluctuations between 5.57 dBi and 5.31 dBi.

In FIG. 7 is shown the vertical radiation diagram of an emitter according to the invention with an advantageously increased gain compared with an aerial of the same height according to the state of the art, and FIG. 8 shows the azimuthal round diagram with the azimuthal fluctuation Gmax-Gmin ~0.26 dB. The increase in gain in frequencies around the resonant frequency fo is due to the distance between the vertical emitters 4*a*-4*c* and their effect as a group of emitters with currents excited in the same direction, which however on the other hand, with not too great a distance between, them causes only the above-mentioned slight azimuthal fluctuation of gain.

Although the requirement of a low geometric aerial height h is one of the main objects for the design of a vehicle aerial, and is required particularly for aerials which in the frequency range around 1.5 GHz, for example for the DAB radio service in the L-frequency band, have an aerial height of h=1 cm, that is, h/λo=1/20, the extent of the ring circuit 2 is basically not limited to similarly low values. Therefore associated with the emitter according to the invention is the advantage that the transverse extent of the ring conductor 2 referred to the wavelength λo is not limited to similarly low values, as is the case for its height h. As a result it is possible to increase the bandwidth of the emitter with the same relative emitter height h/λo, or alternatively with the same bandwidth to further reduce the height. The example of an emitter according to the invention with a circular ring circuit 2 as in FIG. 1, but with four azimuthally equally distributed vertical emitters 4*a*-4*c* and the same height h=1 cm can serve for illustration, which with a relative diameter of D/λo=0.32 at the frequency around 1.5 GHz has the relative bandwidth Brel=B/fo ~9%. Compared with this, the relative bandwidths Brel ~3.6% given in FIGS. 4D, 6A and 6C are smaller approximately by the ratio between the length of the square boundary of the ring circuit 2 to the circumference of the circular ring circuit. The capacitance of the ring conductor 2 is thus given approximately by the developed length of its outer boundary, and contributes linearly to forming the bandwidth B of the impedance around the resonant frequency fo.

Advantageously, the azimuthal radiation diagram is also given as a round diagram in the case of comparatively long transverse extents of the ring conductor 2. In the above-mentioned example of an aerial with circular ring conductor and the relative diameter of D/λo=0.32, the developed length of a ring conductor section between two adjacent ring circuit coupling points 7*a*-7*b* etc. is in each case one quarter-wavelength=λo/4. Although the distance between two mutually opposed vertical emitters D/λo is 0.32 and in this respect is no longer small compared with the wavelength λo, the azimuthal variation of the emitter gain is less than 0.3 dBi.

Below, some advantageous forms are constructed for producing emitters according to the invention.

Figure 11:
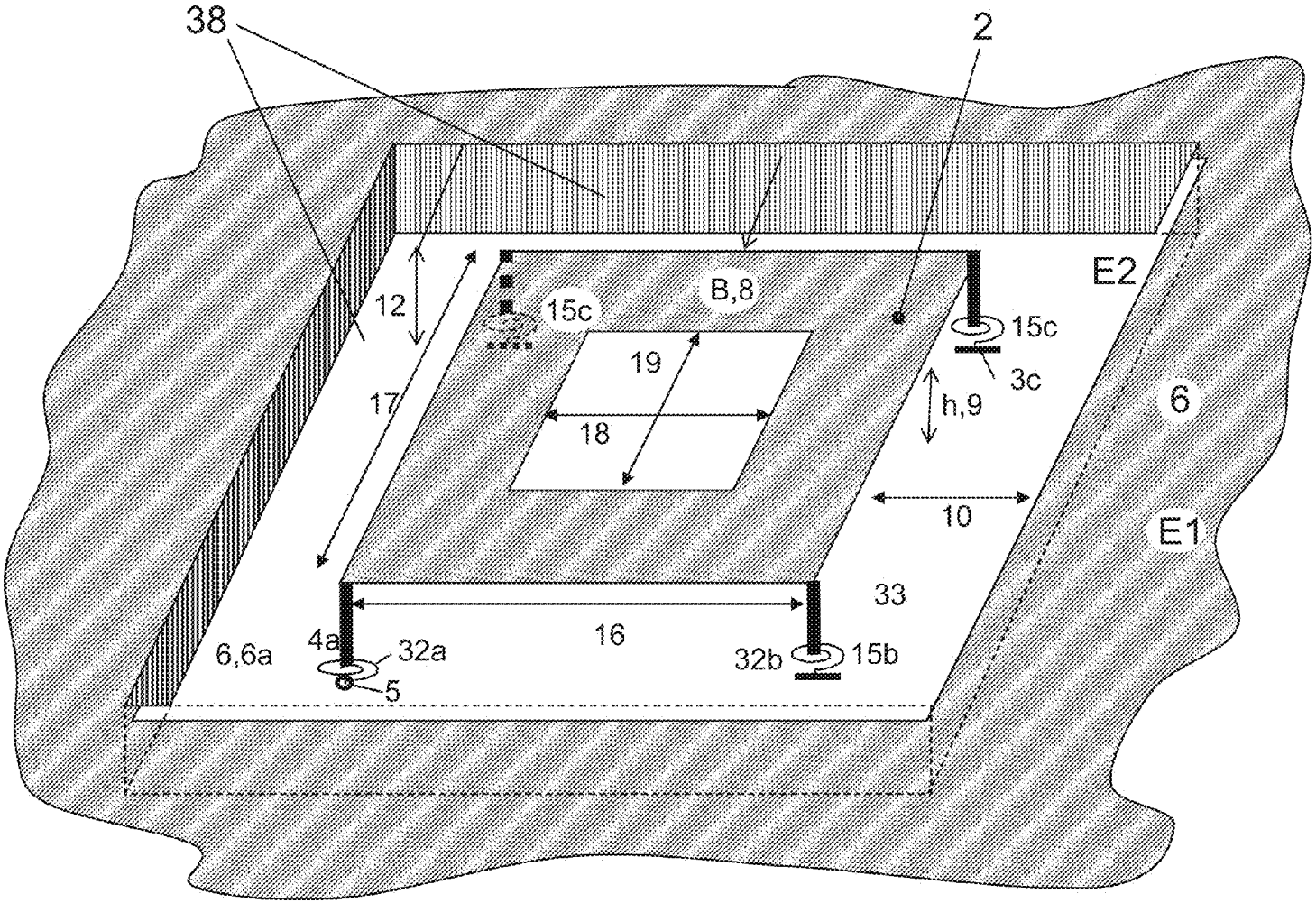
FIG. 11, illustrates an emitter according to the invention in sufficient cavity depth 12, which is formed by moulding the conductive base area 6, so that the emitter is for example integrated in the vehicle body without elevation above the body surface. The base surface 39 of the cavity 38 is in the example designed as a printed circuit board, and the inductively operating components 13*a*-13*d* are constructed as printed inductances 32*a*, 32*b*, 32*c*, 32*d;*

In a design of a ring conductor 2 with the vertical emitters 4 which is as simple and economical as possible, the ring conductor 2 is designed as a closed, approximately wire-like ring to which the vertical emitters 4 are electrically connected. This ring conductor 2 with emitters 4 can economically be stamped from sheet metal and made by subsequent bending of the emitters 4. In an advantageous manner the conductive base area in the region of the emitter 1 is constructed as a printed circuit board. On this can be printed the inductances 15, for example as spiral strip conductors, as shown in FIG. 11, a terminal pad being printed at one end of one of the inductances 15 as an emitter terminal point. The prefabricated emitter part can be connected by the lower ends of the vertical emitters in a simple manner to the inductances 15, for example by soldering, resulting in a mechanically extremely stable emitter construction. This mechanical stability is of great advantage, particularly with respect to the narrow relative bandwidth of many wireless communication services, which prevents detuning by mechanical vibrations and ensures high reproducibility in the manufacturing process.

With an emitter of this kind with electrically coupled vertical emitters 4, the ring conductor 2 can be made two-dimensional in the horizontal plane and its outer boundary can be made substantially symmetrical to its centre Z, wherein the inner boundary of the ring conductor 2 is constructed in such a way that, along the circumference, the ring conductor width B is in each case smaller than ¼ of the horizontal extent of the ring conductor measured across the centre Z. As a result, in an advantageous manner the space around the centre Z of the ring conductor 2 is available for the design of further aerials by way of example.

As already stated above, the currents in the vertical emitters 4 having the same direction is important for the resulting optimum support of the vertically polarised radiation. This can be achieved particularly advantageously if the ring conductor 2 is circular or designed as a regular polygon with N corners and, via the circumference L of the circle or at the corners of the polygon with N corners via the circumference of the length L of the ring conductor 2, vertical emitters 4*a*-d which are the same as each other in number N are electrically coupled 6 to the ring conductor 2 via the conductor loop coupling points 7*a*-*d* at equal intervals of the developed length L/N of the structure from each other. In this case according to the invention the resonance at frequency fo is brought about by designing the inductively operating components 13*a*-*d* of the vertical emitters 4*a*-*d*. To produce the resonance of the ring circuit emitter 1, the vertical emitters 4*a*-*d* can also be wired in each case at a break point with an inductance 15*a*-*d* of the inductive components 13*a*-*d* necessary for this purpose.

In a particularly advantageous embodiment of the invention, the components 13*a*-d which operate inductively in the vertical emitters 4*b*-*d* have approximately the same size in all of the vertical emitters 4*a*-*d*, so that, as already stated above, currents having the same direction and approximately the same quantity, flow at resonance in these emitters 4*a*-*d*. This condition, however, does not necessarily have to be meticulously observed for basic perception of the advantages obtainable with the invention with a view to a favourable emitter impedance. By keeping the currents equal, however, optimum conditions can be achieved with respect to the emitter impedance and the azimuthal directional independence of the directional diagram.

The choice of a break point for switching on concentrated inductive components is made, for the manufacture of the emitter 1, particularly favourably in each case at the lower end of a rod-shaped vertical emitter 4*a*-*d*. There, in each case a concentrated inductance 32*a*-32*c* can be connected between the lower end of the rod-shaped vertical emitter 4*a*-d and the conductive base area 6 or the terminal of the emitter infeed point 5 which is located there. The other terminal of the emitter infeed point 5 is formed on the conductive base area 6. As already shown above, the inductances 15*a*-*d* can advantageously be designed as printed inductances 32*a*-*d* on the electrically conductive base area 6 designed as an electroconductively coated printed circuit board, which are in each case connected at one end to the vertical emitter 4*a*-*d* and at the other end to the electrically conductive base area 6 or a terminal of the emitter infeed point 5 which is also formed on the coated printed circuit board.

Figure 9:
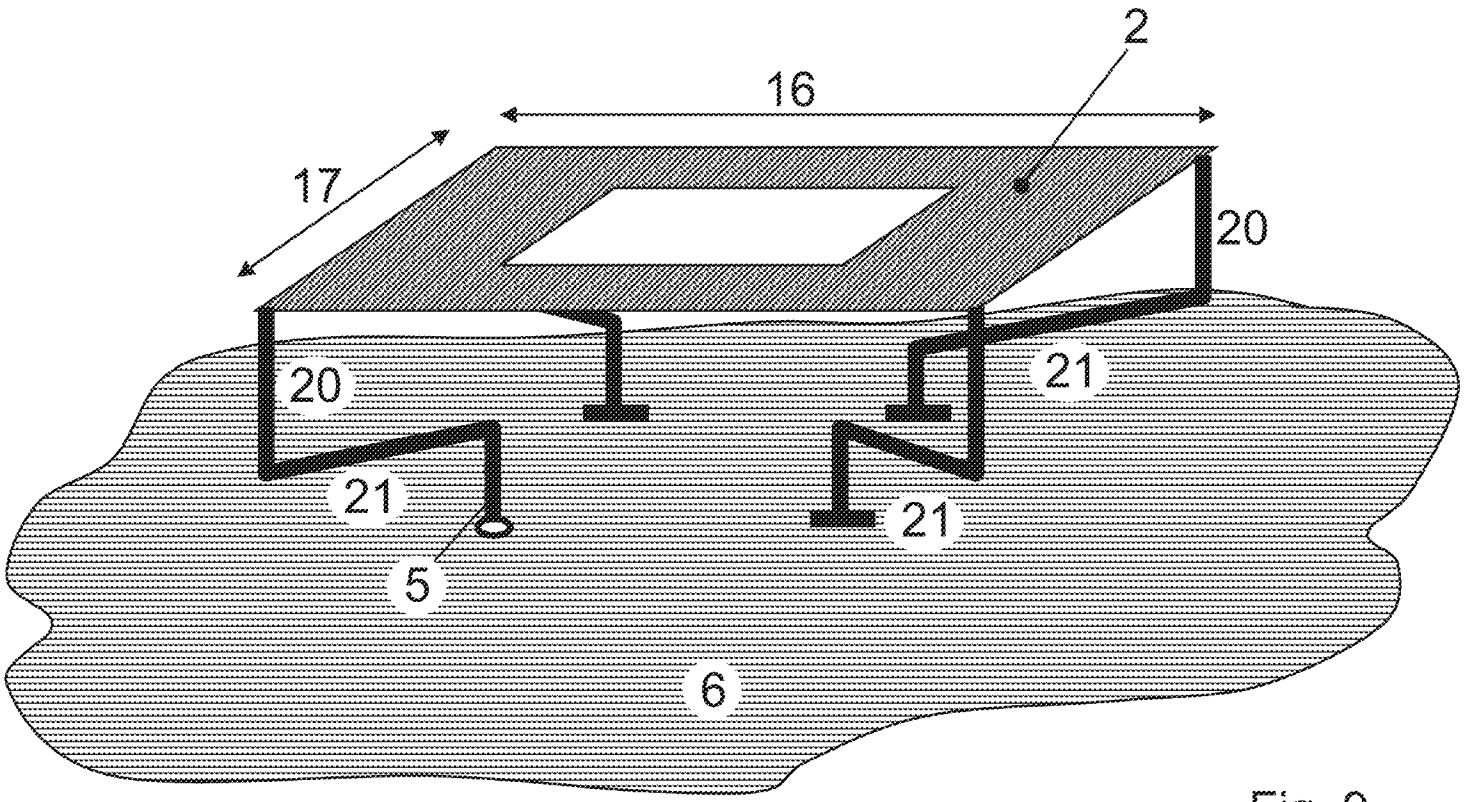
FIG. 9, illustrates the construction of an emitter according to the invention with rectangular ring conductor 2 as an example, with external transverse dimension 16 and external longitudinal dimension 17, and design of the vertical emitters in such a way that the inductively operating components 13*a*-13*d* necessary for resonance in the individual emitters are in each case provided by shaping of vertical emitter parts 20 and horizontal emitter parts 21. By choice of suitable dimensions, matching to ZL can be obtained at the emitter infeed point 5 without further matching elements, so that the aerial terminal point 24 is provided by the emitter infeed point 5.
Figure 10:
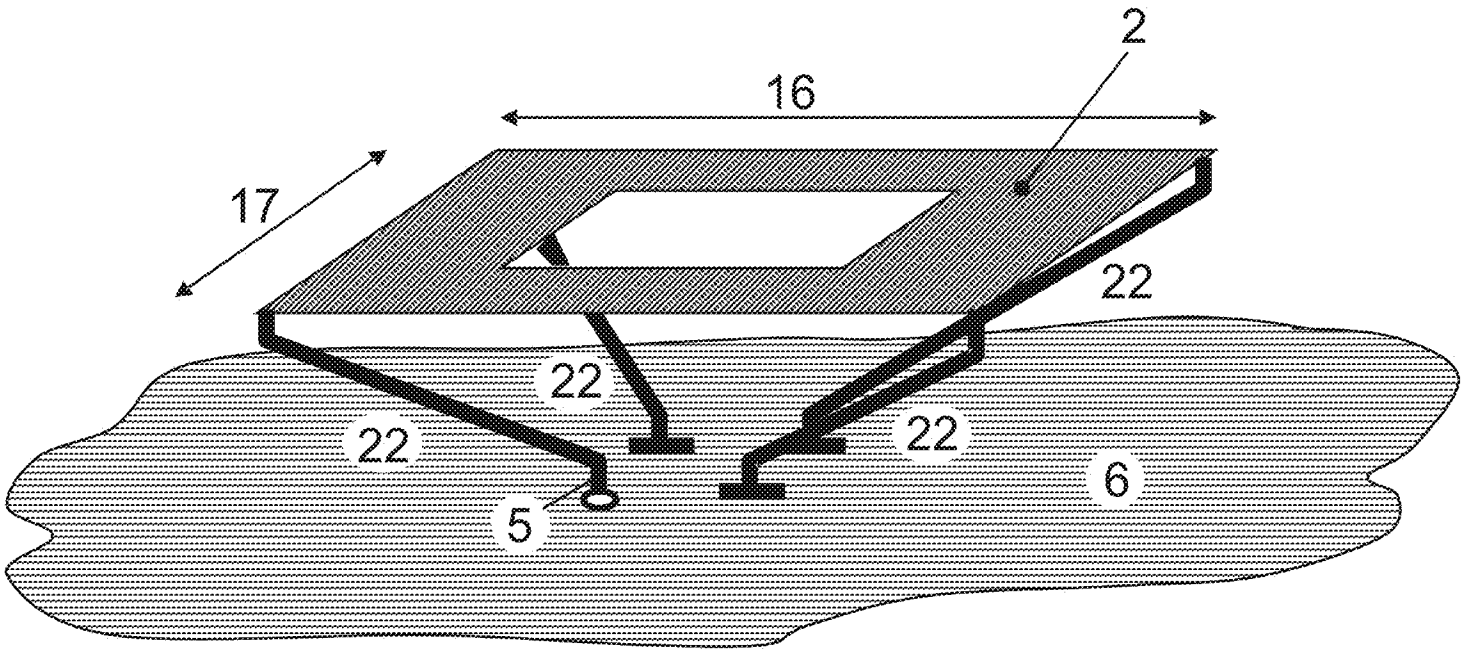
FIG. 10, illustrates an example as in FIG. 9, but with obliquely extending emitter parts 22 of the vertical emitters 4*a*, 4*b*, 4*c*, 4*d;*

In a further advantageous embodiment of the invention, the inductances 32*a*-*d* can be omitted if the inductively operating components 13*a*-13*d* are in each case constructed by shaping the vertical emitters 20. For this purpose vertical emitter parts 20 and horizontally extending emitter parts 21 are formed, so that the necessary inductive components 13*a*-13*c* shown in FIG. 1 are also achieved with a low height h. In this case the design of the vertical emitter parts 20 and the horizontally extending emitter parts 21 can be combined similarly in FIG. 9 by obliquely extending emitter parts 22, as shown in FIG. 10, or produced by meander-like emitter parts. An emitter 1 with vertical emitters 4*a*-*c* of this kind can for example be made economically from a piece stamped from sheet metal and subsequently bent, and the vertical emitters can be connected at their lower end to the conductive base area 6 or to the emitter infeed point 5 which is formed there. A particularly economical solution for use in vehicles can be achieved by the choice of suitable dimensions of the emitter 1 in such a way that at the emitter infeed point 5 there is matching to ZL without a matching network 35, and the emitter infeed point 5—according to the general view at the bottom left of FIG. 4*a*—forms the aerial terminal point 34 of an aerial 36 matched to ZL.

With slightly too low a resonance resistance Rs, impedance matching to ZL can easily take place by the fact that the resonant frequency fo is selected in such a way that the slight detuning of resonance of the emitter that occurs at a slightly higher frequency f in the frequency band of the wireless communication service and the impedance occurring between emitter infeed point 5 and the adjacent earth terminal point 3*a* is inductive. By parallel connection of a capacitance between emitter infeed point 5 and the adjacent earth terminal point 3*a*, impedance matching to ZL can easily be achieved, as a result of which the emitter infeed point 5 also forms the aerial terminal point 34 of an aerial 36 matched to ZL.

In a basic form of an emitter 1 according to the invention which is advantageously easy to manufacture, the ring conductor 2 is designed as a square, at each corner of which is formed a ring circuit coupling point 7 with a vertical emitter 4, 4*a-d* electrically connected there. Three of the emitters 4, 4*b-d* are connected by the electrically conductive base area 6 for coupling to an earth terminal point 3*b-d* in each case via an inductance 13*b-d* to the earth terminal point 3*b-d*, and an emitter 4, 4*a* is if occasion arises connected via an inductance 13*a* to the emitter infeed point 5.

For an emitter—for example for the above-mentioned DAB radio service in the L-frequency band at a centre frequency of f ~1.5 GHz—in an advantageous embodiment according to the invention the resonant frequency fo is approximately equal to the centre frequency f of the radio service and the sides of the square are approximately equal to λo/10 and the height h, 9 is approximately equal to λo/20. An emitter with these external dimensions can advantageously be designed in such a way that there is impedance matching to ZL at the emitter infeed point 5 and so the aerial terminal point 34 is provided by the latter.

High demands are made of the smoothness of the surface of a vehicle body, mainly for aesthetic reasons, but also for reasons of the generation of wind noise. For this purpose an emitter according to the invention advantageously offers the possibility of countersinking the emitter into the vehicle body without significant losses of its radiation properties. Also, as shown in FIG. 11, the conductive base area 6 which extends substantially in a base area plane E1 is formed at the location of the ring conductor 2 as an open-topped conductive cavity 38, of which the conductive cavity base surface 6*a* in the cavity depth 12 runs parallel to the base area plane E2 located below the base area plane E1. The ring conductor 2 is introduced into this cavity in a further horizontal ring circuit plane E at height h, 9, extending over the cavity base surface 6*a* in such a way that the conductive cavity base surface 6*a* at least covers the projection surface of the ring conductor 2 on the base area plane E2 located below the conductive base area plane E1, and the cavity side surfaces 40 at each point have a contour such that there is a large enough cavity distance 10 between the ring conductor 2 and the cavity 38 at each point. Naturally a fall in the radiation resistance Rs is connected with countersinking of an emitter. In particular in this connection too, the increase in radiation resistance by a factor of $N^2$ over a reference emitter 29 according to the invention is of particular importance.

Figures 14A, 14B:
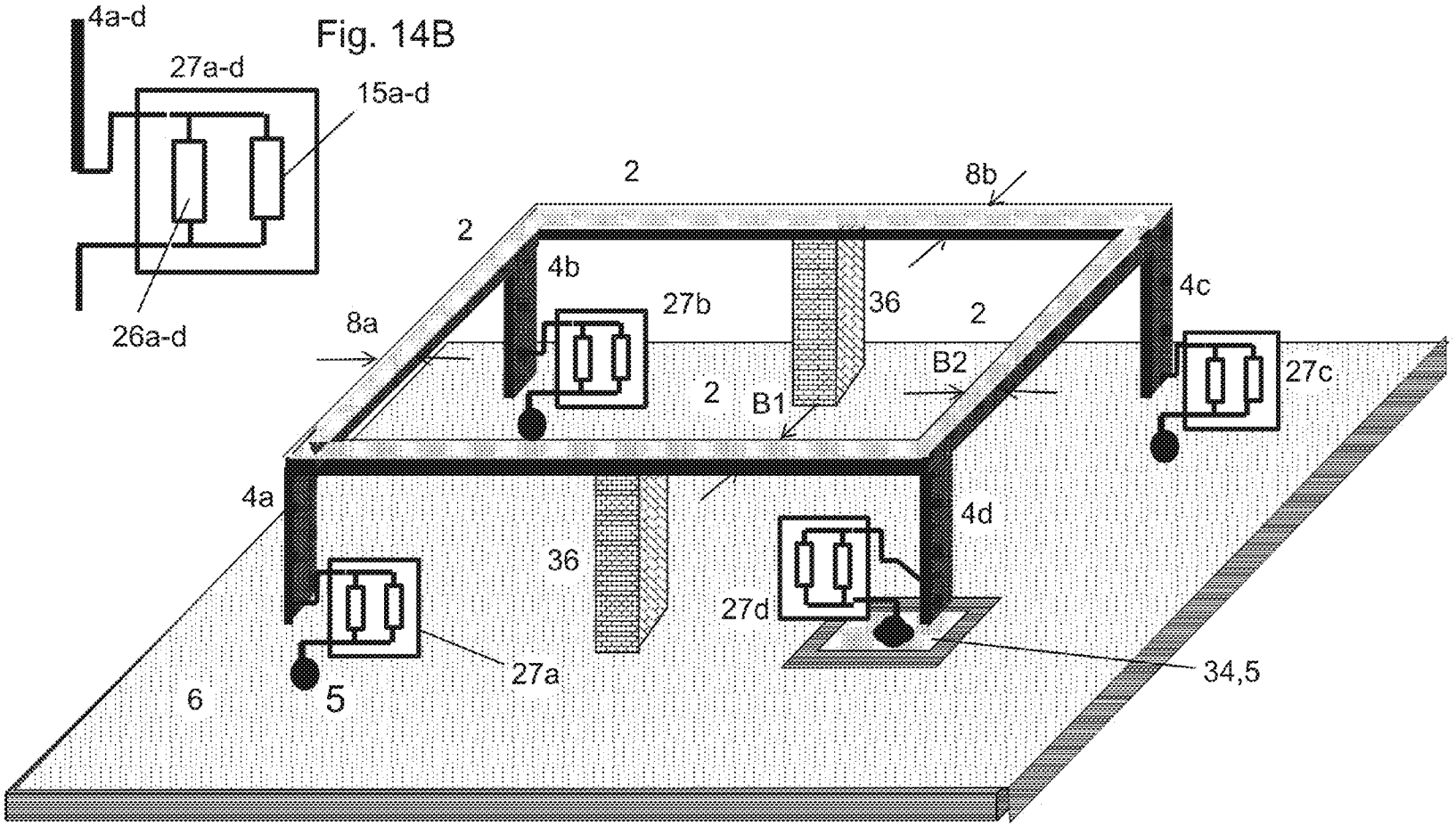
FIGS. 14A and 14B, illustrate an example of an emitter according to the invention in combination with an aerial for the reception of circularly polarised satellite wireless signals at a higher frequency fs than for the wireless communication service with vertical polarisation. In the example, at the lower end of the vertical emitters 4 instead of the printed inductance 32*a*, 32*b*, 32*c*, 32*d* in FIG. 11 is formed in each case a frequency-selective two-terminal circuit which as an example in each case consists of the parallel circuit of a capacitively operating element 26 and an inductance 15*a*, 15*b*, 15*c*, 15*d*, so that at the lower frequency the desired inductive effect is provided, and at the higher frequency fs the desired capacitive effect of the dummy circuit 27*a-d*. The ring conductor 2 forms at the higher frequency fs a ring circuit which is in resonance due to the capacitive effect of the dummy circuit 27, forming a revolving wave on this circuit, so that circular polarisation is provided at this frequency fs.

In a further advantageous embodiment of the invention the emitter 1, which is designed for vertical polarisation for a wireless communication service around the frequency fo, is extended in its function for the reception of circularly polarised satellite wireless signals of a satellite wireless communication service at a frequency fs>fo, as shown by way of example in FIGS. 14A and 14B. By contrast with the function for vertical polarisation with currents flowing in phase and in the same direction in the vertical emitters 4*a-c*, the phases of the currents in these emitters are adjusted in such a way that the ring conductor 2 together with the conductive base area 6 is operated as a ring circuit, so that at frequency fs a resonance structure is formed in such a way that, by infeed via one of the vertical emitters 4*d* with emitter infeed point 5 on the ring circuit, the current distribution of a running circuit wave is adjusted is a single direction of rotation of which the phase difference over one azimuthal revolution is 2π. Supply of the emitter for the function of circular polarisation can advantageously also take place at the emitter infeed point 5. An emitter for the reception of circularly polarised satellite signals is known from DE 10 2009 040 910, e.g. in FIG. 17, where the supply at a vertical emitter is provided via a capacitance, and connection of the other emitters to the electrically conductive base area 6 is provided similarly via capacitances. To link the two functions in an emitter according to the present invention, as in FIG. 14A, a capacitively operating element 26*a-d* is connected in parallel with each of the inductances 15*a-d* of the vertical emitters 4*a-c* coupled to the conductive base plane, as well as with one vertical emitter 4*d* with emitter infeed point 5. Thus, as shown in FIG. 14B, in each case there is a dummy circuit 27*a-d* which, for the wireless communication service at frequency f, further has the required inductive effect, and at frequency fs for the satellite wireless communication service has the capacitive effect which determines the resonance and the direction of rotation of the revolving wave.

Figure 15B:
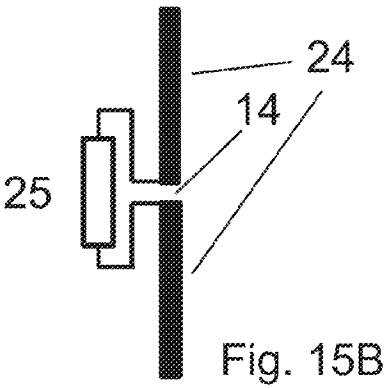
FIG. 15B, illustrates the break points are bridged by frequency-selective two-terminal circuits 25 which have high resistance at the frequency fo and low resistance in the frequency ranges of the other wireless communication services.
Figure 15A:
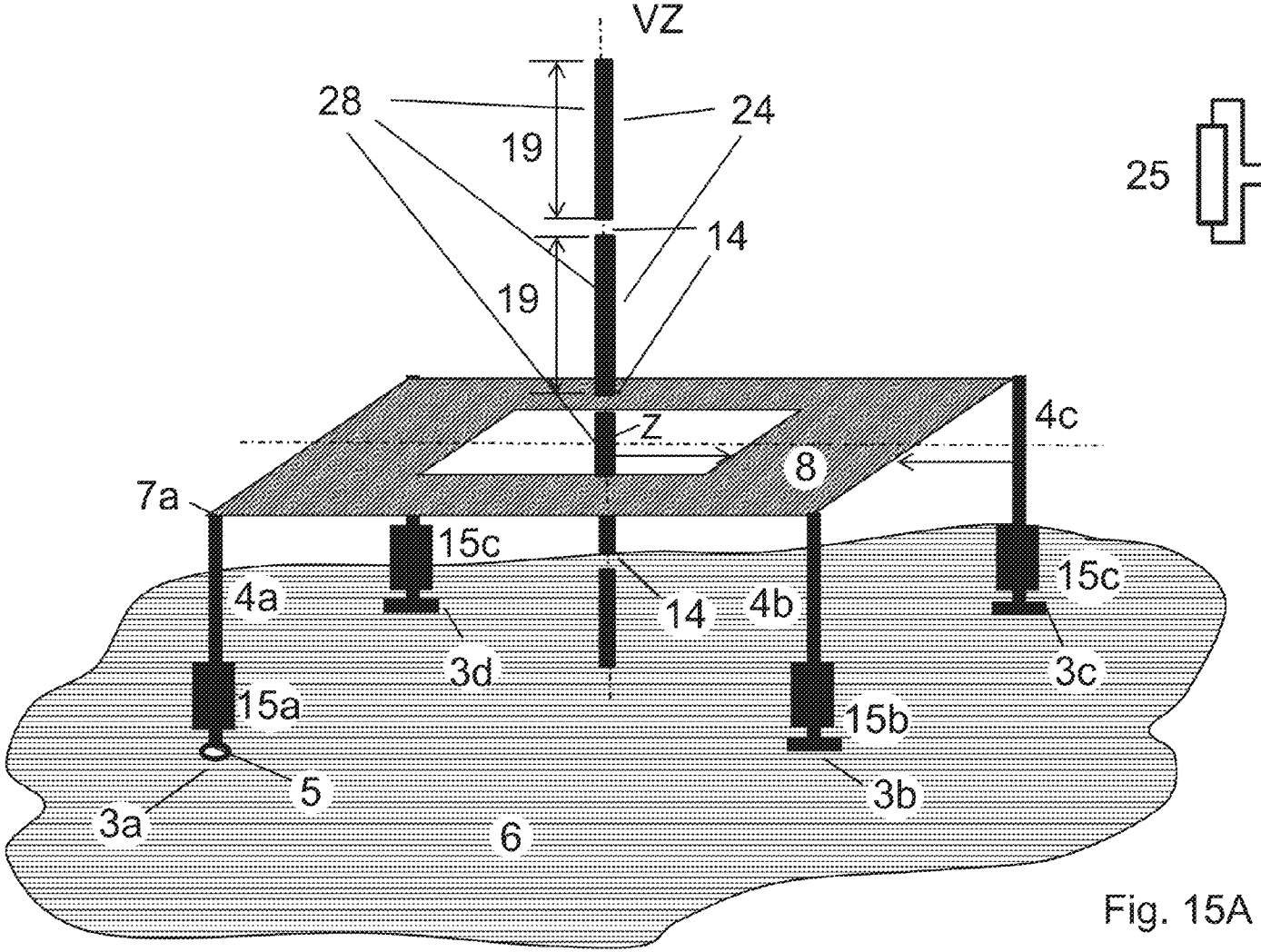
FIG. 15A, illustrates the advantageous combination of an emitter with not too wide a ring conductor 2 according to the invention with a substantially rod-like emitter 28 at the centre Z of the ring conductor 2 for a further wireless communication service or several further wireless communication services with vertical polarisation at frequencies other than fo. To avoid radiation coupling between the two emitters, the rod-like emitter 28 is divided into conductor sections 24 of which the electrical length is not greater than ⅜*λo.

In a further advantageous embodiment of the invention, the free space which can be formed at the centre of the ring conductor 2 for mounting a further vertically polarised aerial is used as shown by way of example in FIG. 15A with a rod-shaped aerial 28. For this purpose advantageously along a vertical central line VZ a vertical substantially rod-shaped aerial for at least one further wireless communication service can be formed. To suppress the radiation coupling between the emitter 1 according to the invention and the further vertically polarised rod-shaped aerial 28, its conductor is divided into separate conductor sections 24 by break points 14 in such a way that the developed lengths 19 of the conductor sections 24 are not greater than ⅜ of the wavelength λo, and the break points 14 are bridged by frequency-selective two-terminal circuits 25, as shown in FIG. 15B. The frequency-selective two-terminal circuits 25 are to be made low-resistance in the frequency ranges of the further wireless communication services, and high-resistance in the frequency range which is assigned to the emitter 1 with ring conductor 2. The design of rod-shaped aerials which are radiation-uncoupled by frequency-selectively bridged break points is known from DE 103 04 911.

Figure 3:
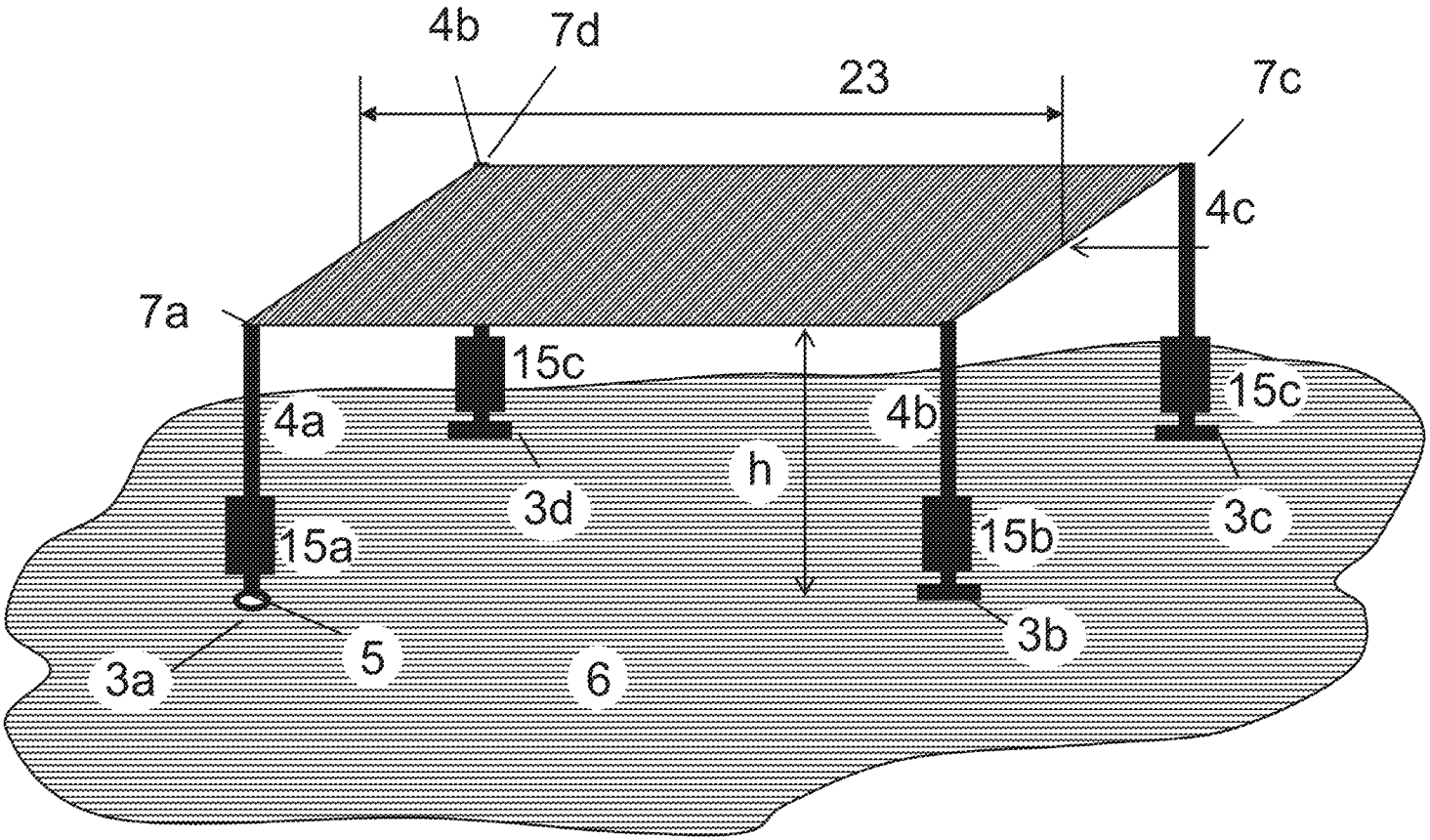
FIG. 3, illustrates the emitter according to the invention as in FIG. 2, but with the peculiarity that the width of the ring conductor 2 is selected such that within the outer boundary of the ring conductor 2 is formed a closed, conductive surface.

Lastly, for example for reasons of increased mechanical stability requirements it may be necessary to make the ring conductor 2 as stable as possible. In this case the ring conductor 2 can essentially be formed by the boundary of a closed conductive area, as in FIG. 3, wherein the ring circuit coupling points 7*a*, 7*b*, 7*c*, 7*d* are in each case formed in the vicinity of this boundary. The electrical properties, e.g. the radiation resistance Rs at the resonant frequency fo, are only insignificantly affected by forming the ring conductor 2 as a closed surface due to the currents which are essential for operation along the boundary of the surface. This applies similarly to the relative emitter bandwidth Brel.

Starting from the bandwidth of an electrically small emitter, the bandwidth B can theoretically be increased by a maximum factor of 2π/ln2 by adding a matching network at the aerial terminal point 34, assuming any complicated matching network without loss, as cited in the publications mentioned at the beginning in the Archiv für Elektronik and Übertragung. The amplification factors which can be achieved in practice are, however, lower with justifiable expenditure, the more the emitter impedance differs from the target impedance ZL. Naturally, losses increase the bandwidth, but reduce the radiation gain of an aerial to the same extent. Thus the emitter 1 according to the invention when supplemented with a matching network and taking into consideration losses with respect to radiation gain and achievable bandwidth is always superior to the reference emitter 29 with matching network.

What is claimed is:

1. An electric emitter for vertically polarized wireless signals for a wireless communication service with a narrow frequency bandwidth around a frequency fo in the gigahertz range and characterized by a free-space wavelength λo, said emitter comprising:

at least one substantially horizontally oriented conductor loop arranged above a conductive base area, with an emitter infeed point for electromagnetic excitation of the conductor loop relative to the conductive base area, wherein the conductor loop is formed by a polygonally or elliptically/circularly closed ring conductor running in a substantially horizontal plane with a height h of less than λo/6 over the conductive base area, said conductor loop characterized by a capacitance value, equally distributed over the periphery of the conductor loop are at least three vertical emitters electromagnetically coupled to the conductor loop at coupling points defined by the conductor loop, wherein said vertical emitters extend between the conductor loop and the conductive base area, wherein at least two of the vertical emitters are electromagnetically coupled to the electrically conductive base area at earth terminal points, and a vertical emitter is excited via the emitter infeed point at a lower end thereof, the vertical emitters coupled to the electrically conductive base area between their conductor loop coupling points and the earth terminal point and the vertical emitter which is excited via the emitter infeed point, between its conductor loop coupling point and the emitter infeed point, in each case have inductively operating components, and wherein the inductively operating components comprise inductors connected to respective lower ends of the vertical emitters between the vertical emitters and the electrically conductive base, wherein respective sizes of each of said inductors are approximately equal in each of the vertical emitters, and wherein the respective sizes are selected such that currents flowing in each of the vertical emitters at resonance (i) flow in the same direction and (ii) are approximately equal, such that a low-resistance resonance having the character of a series resonance is provided at the emitter infeed point at the frequency fo.

2. The emitter of claim 1, wherein the ring conductor is designed as a closed wire ring and coupled to the vertical emitters by electrical connection.

3. The emitter of claim 1, wherein the ring conductor is made two-dimensional in the horizontal plane and its outer boundary is made substantially symmetrical to its center Z and its inner boundary is constructed in such a way that, along the circumference, the ring conductor width B is in each case smaller than ¼ of the horizontal extent of the ring conductor measured across the center Z of the ring conductor.

4. The emitter of claim 1, wherein the ring conductor is circular or designed as a regular polygon with N corners and, over the circumference L of the circle or at the corners of the polygon with N corners, over the circumference of the length (L) of the ring conductor, N vertical emitters which are the same as each other, are electrically coupled to the ring conductor via the conductor loop coupling points at equal intervals of the developed length (L/N) of the ring conductor structure from each other, and the resonance at frequency fo is brought about by designing the inductively operating components of the vertical emitters.

5. The emitter of claim 1, wherein to produce the resonance of the ring circuit emitter, the vertical emitters are wired in each case at a break point with an inductance having the inductive reactance XL necessary for this purpose.

6. The emitter of claim 1, wherein the resonant frequency fo is selected in such a way that the slight detuning of resonance of the emitter that occurs at a slightly higher frequency fin the frequency band of the wireless communication service and the impedance occurring between emitter infeed point and the adjacent earth terminal point is inductive so that, in case of parallel connection of a capacitance between emitter infeed point and the adjacent earth terminal point, there is impedance matching to a predetermined target impedance ZL and the emitter infeed point forms the aerial terminal point of an aerial matched to ZL.

7. The emitter of claim 1, wherein the resonant frequency fo is selected in such a way that the slight detuning of resonance of the emitter that occurs at a slightly lower frequency fin the frequency band of the wireless communication service and the impedance occurring between emitter infeed point and the adjacent earth terminal point is capacitive in such a way that, in case of parallel connection of an inductance between emitter infeed point and the adjacent earth terminal point, there is impedance matching to a predetermined target impedance ZL and the emitter infeed point forms the aerial terminal point of an aerial matched to ZL.

8. The emitter of claim 1, wherein the ring conductor is designed as a square with sides, at each comer of which is formed a ring circuit coupling point with a vertical emitter electrically connected there, and three emitters are connected by the electrically conductive base area for coupling to an earth terminal point in each case via an inductance to an earth terminal point, and an emitter is connected via an inductance to the emitter infeed point.

9. The emitter of claim 8, wherein the resonant frequency fo is approximately equal to a center frequency f of the radio service and the sides of the square are approximately equal to λo/10 and the height his approximately equal to λo/20 , so that impedance matching to a predetermined target impedance ZL prevails at the emitter infeed point and the aerial terminal point is provided by the latter.

10. The emitter of claim 1, wherein the inductors are formed in printed circuit technology on the electrically conductive base area designed as an electroconductively coated printed circuit board, which are in each case connected at one end to the vertical emitter and at the other end to the electrically conductive base area or the emitter infeed point which is also formed on the coated printed circuit board.

11. The emitter of claim 1, wherein the inductively operating components necessary for resonance are in each case provided by shaping of the vertical emitters in such a way that in the vertical emitters there are vertical emitter parts and horizontal emitter parts or meander-like or obliquely extending emitter parts.

12. The emitter of claim 1, wherein the electrically conductive base area which extends substantially in a base area plane (E1) is formed at the location of the ring conductor as an open-topped electrically conductive cavity, of which the electrically conductive cavity base surface runs in a base area plane (E2) located parallel to and below the base area plane (E1) in the cavity depth and into which the ring conductor is introduced in a further horizontal ring circuit plane (E) at height h, extending over the cavity base surface, and the cavity base surface at least covers the projection surface of the ring conductor on the base area plane (E2) located below the conductive base area plane (E1), and the electrically conductive cavity side surfaces at each point have a contour such that there is a large enough cavity distance between the ring conductor and the cavity at each point.

13. The emitter of claim 1, wherein the emitter is designed for the additional reception of circularly polarized satellite wireless signals of a satellite wireless communication service at a frequency fs>f, wherein the ring conductor together with the conductive base area forms a ring circuit, so that at frequency fs a resonance structure is formed in such a way that, by infeed via one of the vertical emitters with emitter infeed point on the ring circuit, the current distribution of a running circuit wave is adjusted in a single direction of rotation of which the phase difference over one azimuthal revolution is $2\pi$, wherein a capacitively operating element is connected in parallel with each of the inductors of the vertical emitters coupled to the conductive base plane, as well as with one vertical emitter with emitter infeed point, so that there is a dummy circuit which, for the wireless communication service at frequency f, further has the required inductive effect, and at frequency fs for the satellite wireless communication service has the capacitive effect which determines the resonance and the direction of rotation of the revolving wave.

14. The emitter of claim 1, wherein at a center Z of the ring conductor along a vertical central line VZ a vertical rod-shaped aerial for at least one further wireless communication service is divided into separate conductor sections by break points in such a way that the developed lengths of the conductor sections are not greater than ⅜ of the wavelength $\lambda o$, and the break points are bridged by frequency selective two-terminal circuits which are low-resistance in the frequency ranges of the further wireless communication services, and high-resistance in the frequency range which is assigned to the emitter with ring conductor.

15. The emitter of claim 1, wherein the ring conductor is essentially formed by the boundary of a closed conductive area, and the ring circuit coupling points are in each case formed in the vicinity of this boundary.

* * * * *